US009529301B2

(12) United States Patent
Murakawa et al.

(10) Patent No.: US 9,529,301 B2
(45) Date of Patent: Dec. 27, 2016

(54) IMAGE FORMING APPARATUS, DRUM UNIT, AND DEVELOPING UNIT

(71) Applicant: KONICA MINOLTA, INC., Chiyoda-ku, Tokyo (JP)

(72) Inventors: Junji Murakawa, Toyokawa (JP); Takeru Kinoshita, Toyokawa (JP); Hideji Hayashi, Okazaki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/040,395

(22) Filed: Feb. 10, 2016

(65) Prior Publication Data

US 2016/0246214 A1 Aug. 25, 2016

(30) Foreign Application Priority Data

Feb. 24, 2015 (JP) ..... 2015-034280

(51) Int. Cl.
*G03G 15/00* (2006.01)
*G03G 15/08* (2006.01)

(52) U.S. Cl.
CPC ..... *G03G 15/0865* (2013.01)

(58) Field of Classification Search
CPC ..... G03G 15/0865
USPC ..... 399/13, 299
See application file for complete search history.

(56) References Cited

U.S. PATENT DOCUMENTS

2012/0093523 A1* 4/2012 Kamoshida ..... G03G 21/1875 399/12

FOREIGN PATENT DOCUMENTS

JP 2010-217658 A 9/2010

* cited by examiner

*Primary Examiner* — Quana M Grainger
(74) *Attorney, Agent, or Firm* — Buchanan Ingersoll & Rooney PC

(57) ABSTRACT

An image forming apparatus comprises image forming sections for each color, each including a pressure receiving parts pair in a first outer region of a first rotary body and a second rotary body as an image carrier and a developing roller. A first image forming section includes a first pressure receiving part of the first rotary body and a second pressure receiving part of the second rotary body as the pressure receiving parts pair. A second image forming section includes a third pressure receiving part of the first rotary body and a fourth pressure receiving part of the second rotary body as the pressure receiving parts pair. A protruding distance of the first pressure receiving part is smaller than a protruding distance of the third pressure receiving part. A protruding distance of the second pressure receiving part is larger than a protruding distance of the fourth pressure receiving part.

8 Claims, 15 Drawing Sheets

IMAGE FORMING APPARATUS, DRUM UNIT, AND DEVELOPING UNIT

CROSS-REFERENCE TO RELATED APPLICATIONS

This application is based upon and claims the benefit of priority from the prior Japanese Patent Application No. 2015-034280 filed on Feb. 24, 2015, the entire contents of which are incorporated herein by reference.

BACKGROUND OF THE INVENTION

Field of the Invention

The present invention relates to an image forming apparatus, a drum unit, and a developing unit. More specifically, the present invention relates to an image forming apparatus, a drum unit, and a developing unit to form a color image by toners of plural colors.

Description of Related Art

An image forming apparatus for forming a color image by a tandem electrophotographic color printer includes an image carrier and a developing roller for each color to form a toner image with the corresponding color. The image carrier is used up by image forming, and hence a drum unit including the thus consumed image carrier needs to be replaced. Further, when the drum units have different configurations for each color, some measures are required to prevent wrong insertion of a drum unit for different color for replacement.

For example, Japanese Patent Application Publication No. JP 2010-217658 teaches a technique of providing protrusions and recesses in a drum unit and in an attachment part of an image forming apparatus in which the drum unit is to be attached in order to prevent wrong attachment of the drum unit. Specifically, these protrusions and recesses are provided in different positions for each color, and thus any drum unit other than a correct drum unit for the corresponding color is not allowed to be attached to the attachment part.

However, some drum units are not so largely different in visual appearance among different colors. Therefore, there is a case that a user erroneously inserts a wrong drum unit into an attachment part for the different color.

Further, the protrusions and the recesses for preventing the wrong attachment are formed by resin molding, which is an inexpensive method in general, and they do not have much strength. As a result, when a user erroneously inserts the drum unit in the attachment part for wrong color, the protrusions and the recesses for preventing the wrong attachment may be broken.

The present invention has been made to solve the above problem of the conventional technique. To be specific, the present invention has objects of providing an image forming apparatus enabling to prevent wrong attachment of a drum unit without causing breakage when a replacement part has the wrong attachment, and further providing a drum unit and a developing unit which can be used as the replacement part of the image forming apparatus.

SUMMARY OF THE INVENTION

To achieve at least one of the abovementioned objects, an image forming apparatus reflecting one aspect of the present invention comprises a plurality of image forming sections for each color, each including an image carrier configured to rotate and carry a toner image during image forming and a developing part provided with a developing roller and configured to contain and apply toner to the image carrier by rotating the developing roller to form a toner image on the image carrier; and a press section configured to press at least one of the image carrier and the developing roller to the other to bring them in a press-contact state during image forming, wherein one of the developing roller and the image carrier is a first rotary body and the other is a second rotary body, and the first rotary body and the second rotary body define a toner image forming region in which the toner is applied from the developing roller to the image carrier, each of the image forming sections for each color includes a pair of pressure receiving parts provided in a first outer region located axially outside the toner image forming region, the image forming sections for each color include a first image forming section and a second image forming section, the first image forming section is configured to form a toner image of a first color and includes: a first pressure receiving part provided to the first rotary body as one of the pair of pressure receiving parts and formed with a first pressure receiving surface contacted with the other one of the pair of pressure receiving parts in the press-contact state; and a second pressure receiving part provided to the second rotary body as the other one of the pair of pressure receiving parts and formed with a second pressure receiving surface contacted with the first pressure receiving surface in the press-contact state, the second image forming section is configured to form a toner image of a second color that is different from the first color, includes: a third pressure receiving part provided to the first rotary body as one of the pair of pressure receiving parts and formed with a third pressure receiving surface contacted with the other one of the pair of pressure receiving part in the press-contact state; and a fourth pressure receiving part provided to the second rotary body as the other one of the pair of pressure receiving parts and formed with a fourth pressure receiving surface contacted with the third pressure receiving surface in the press-contact state, and the image forming apparatus is configured to satisfy both relationships expressed by: $L1<L3$, and $L2>L4$ in which L1 denotes a protruding distance of the first pressure receiving part extending from a central axis of the first rotary body to the first pressure receiving surface, L2 denotes a protruding distance of the second pressure receiving part extending from a central axis of the second rotary body to the second pressure receiving surface, L3 denotes a protruding distance of the third pressure receiving part extending from the central axis of the first rotary body to the third pressure receiving surface, and L4 denotes a protruding distance of the fourth pressure receiving part extending from the central axis of the second rotary body to the fourth pressure receiving surface.

Further, in the abovementioned image forming apparatus, preferably, each of the first and second image forming sections further includes a pair of pressure receiving parts contacted each other in the press-contact state in a second outer region located opposite to the first outer region interposed with the toner image forming region in the first and second rotary bodies, the first image forming section includes as the pair of pressure receiving parts in the second outer region, a fifth pressure receiving part provided to the first rotary body as one of the pair of pressure receiving parts in the second outer region and formed with a fifth pressure receiving surface contacted with the other one of the pair of pressure receiving parts in the second outer region in the press-contact state; and a sixth pressure receiving part provided to the second rotary body as the other one of the pressure receiving parts in the second outer region and formed with a sixth pressure receiving surface contacted with the fifth pressure receiving surface in the press-contact state, the second image forming section includes as the pair of pressure receiving parts in the second outer region, a seventh pressure receiving part provided to the first rotary body as one of the pair of pressure receiving parts in the second outer region and formed with a seventh pressure receiving surface contacted with the other one of the pressure receiving parts in the second outer region in the press-contact state; and an eighth pressure receiving part provided to the second rotary body as the other one of the pair of pressure receiving parts in the second outer region and formed with an eighth pressure receiving surface contacted with the seventh pressure receiving surface in the press-contact state, and the image forming apparatus is configured to satisfy relationships expressed by: $L1 \neq L5$; $L2 \neq L6$; $L1+L2=L5+L6$; $L3+L4=L7+L8$; and $L1+L4 \neq L5+L8$ in which L5 denotes a protruding distance of the fifth pressure receiving part extending from the central axis of the first rotary body to the fifth pressure receiving surface, L6 denotes a protruding distance of the sixth pressure receiving part extending from the central axis of the second rotary body to the sixth pressure receiving surface, L7 denotes a protruding distance of the seventh pressure receiving part extending from the central axis of the first rotary body to the seventh pressure receiving surface, and L8 denotes a protruding distance of the eighth pressure receiving part extending from the central axis of the second rotary body to the eighth pressure receiving surface.

Further, in the abovementioned image forming apparatus, preferably, the first image forming section includes a first protection region in the first outer region of the first rotary body, the first protection region being located other than in a region provided with the pair of pressure receiving parts, the first protection region includes a first protection part protruding toward the second rotary body from the central axis of the first rotary body, the second image forming section includes a second protection region which is overlapped with the first protection region of the second rotary body, the second protection region including a second protection part protruding toward the first rotary body from the central axis of the second rotary body, and the image forming apparatus is configured to satisfy a relationship expressed by: $L9+L10>LA+LB$ in which L9 denotes a distance of the first protection part extending from the central axis of the first rotary body to a leading end of the first protection part, L10 denotes a distance of the second protection part extending from the central axis of the second rotary body to a leading end of the second protection part, LA denotes a radius of the first rotary body of the first image forming section in the toner image forming section, and LB denotes a radius of the second rotary body of the second image forming section in the toner image forming section.

Further, in the abovementioned image forming apparatus, preferably, the image forming apparatus further includes: a display part for displaying information to a user; a density value output part provided downstream of the first and second image forming sections in a toner-image conveying direction to detect and output a density value indicating a toner application amount on the toner image; a test control part to perform a test control of forming a test pattern of a toner image for a predetermined test on at least one of the first and second image forming sections; and an allowable range recording section to record a predetermined allowable range of the density value of the test pattern, and the test control part performs the test control such that the test pattern is formed by at least one of the first and second image forming sections, and when the density value of the formed test pattern output from the density value output part is outside the allowable range, the display part displays that one of the developing roller and the image carrier is wrongly mounted in one of the first and second image forming sections which formed the test pattern.

Further, in the abovementioned image forming apparatus, preferably, one of the first and second image forming sections is configured to form a black toner image, and the other one is configured to form a toner image with a color other than black.

Further, in the abovementioned image forming apparatus, preferably, the first and second image forming sections each include an adjustment part to adjust the protruding distance of at least one of the pressure receiving parts.

Further, a drum unit reflecting another aspect of the present invention comprises an image carrier configured to rotate and to be applied with toner from a developing roller during image forming, the drum unit being mounted in an image forming section of the image forming apparatus according to claim 1 provided with a press part to press at least one of an image carrier and a developing roller to the other one to bring them in a press-contact state, wherein the drum unit further includes a pressure receiving part provided in the image carrier in an axially outer region located outside a toner image forming region which is to be applied with toner from the developing roller and formed with a pressure receiving surface contacted with a part of the developing roller which is overlapped with the outer region in the press-contact state, and the pressure receiving part has a protruding distance from a central axis of the image carrier to the pressure receiving surface, the distance being different from a distance of the similar type of drum unit including an image carrier to be applied with toner of a different color from a developing roller.

Further, a developing unit reflecting another aspect of the present invention comprises a developing roller to rotate and apply toner to an image carrier during image forming and an accommodation part to accommodate the toner to be supplied to the developing roller, the developing unit being mounted in an image forming section of the image forming apparatus according to claim 1 which is provided with a press part to press at least one of the image carrier and the developing roller onto the other one in image forming to bring them in a press-contact state, wherein the developing unit further includes a pressure receiving part which is provided in the developing roller in an axially outer region located outside a toner image forming region to apply a toner onto the image carrier, and the pressure receiving part has a protruding distance from a central axis of the developing roller to the pressure receiving surface, the distance being different from a distance of the similar type of developing unit including a developing roller to apply a toner with a different color to an image carrier.

DESCRIPTION OF EMBODIMENTS

Detailed embodiments embodying the present invention will be explained below with reference to the accompanying drawings. In the present embodiments, the present invention is embodied in an electrophotographic printer.

First Embodiment

Figure 1:
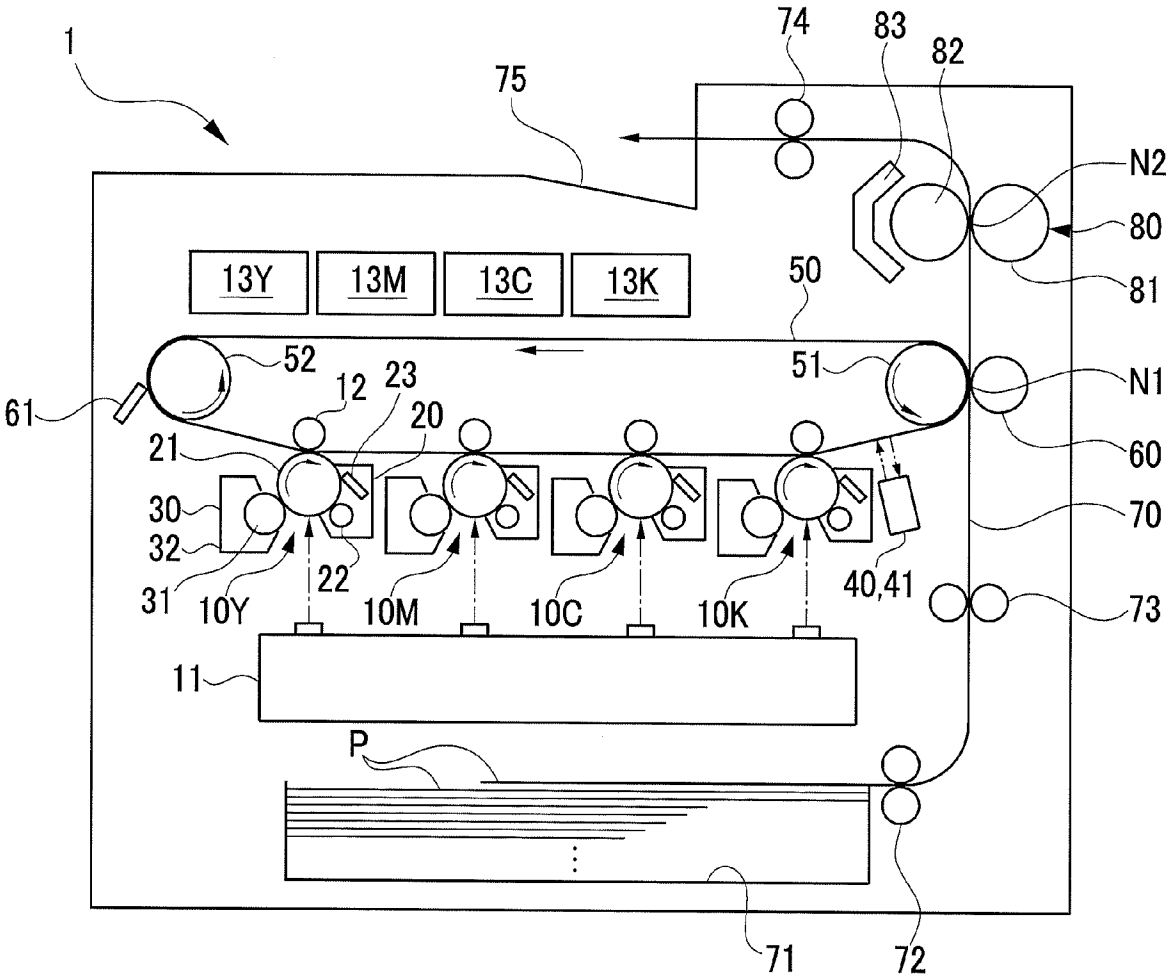
FIG. 1 is a schematic configuration view of an image forming apparatus in embodiments.

FIG. 1 is a schematic configuration view of an image forming apparatus 1 of the present embodiment. The image forming apparatus 1 is a so-called tandem electrophotographic color printer including an intermediate transfer belt 50. This intermediate transfer belt 50 is a conductive endless belt member and is supported on its both ends in FIG. 1 by rollers 51 and 52. In image forming, the roller 51 on a right side in FIG. 1 is driven to rotate counterclockwise. This rotation of the roller 51 causes the intermediate transfer belt 50 and the roller 52 on a left side in FIG. 1 to be rotated in directions indicated with arrows in the figure.

A secondary transfer roller 60 is provided in contact with an outer circumferential surface of a part of the intermediate transfer belt 50 supported by the roller 51 on the right side in FIG. 1. Specifically, the secondary transfer roller 60 is pressed against the intermediate transfer belt 50 from a direction (leftward in FIG. 1) perpendicular to an axis of the roller 60. Contact portions of the intermediate transfer belt 50 and the secondary transfer roller 60 form a transfer nip N1 at which a toner image is transferred from the intermediate transfer belt 50 to a sheet P. In image forming, the secondary transfer roller 60 is driven to rotate by a frictional force caused by press-contact with the rotating intermediate transfer belt 50.

Further, a belt cleaner 61 is placed in contact with an outer circumferential surface of a part of the intermediate transfer belt 50 supported by the roller 52 on the left side in FIG. 1. Specifically, the belt cleaner 61 is press-contacted with the outer circumferential surface of the intermediate transfer belt 50 to collect residual toner having been not transferred to the sheet P at the transfer nip N1.

Image forming sections 10 for each color of yellow (Y), magenta (M), cyan (C), and black (K) are provided in this order from left to right under the intermediate transfer belt 50 in FIG. 1. In the following explanation, when individually specified, the image forming sections 10 for yellow, magenta, cyan, and black are also respectively indicated as image forming sections 10Y, 10M, 10C, and 10K. The image forming sections 10 for each color are configured to form a toner image of the corresponding color and transfer the toner image to the intermediate transfer belt 50. Further, the image forming sections 10 for each color have the similar configuration. Accordingly, in FIG. 1, only the image forming section 10Y is assigned with reference signs of components on behalf of all the image forming sections.

The image forming sections 10Y, 10M, 10C, and 10K are each provided with a photoconductor 21 as a cylindrical electrostatic latent image carrier, and a charger 22, a developing roller 31, and a photoconductor cleaner 23, which are arranged circumferentially around the photoconductor 21. A primary transfer roller 12 is placed in a position opposed to the photoconductor 21 by interposing the intermediate transfer belt 50 therebetween. Further, an exposing unit 11 is disposed below the image forming sections 10Y, 10M, 10C, and 10K for each color in FIG. 1.

The charger 22 is a unit for uniformly charging a surface of the photoconductor 21. The exposing unit 11 is a device for irradiating a laser beam based on image data to the surface of the corresponding photoconductor 21 to form an electrostatic latent image thereon. The developing roller 31 is a unit for applying toner stored in an accommodation part 32 to the surface of the photoconductor 21.

Each primary transfer roller 12 is pressed against the intermediate transfer belt 50 from a direction perpendicular to an axis of the roller 12 (a downward direction in FIG. 1). By this press-contact, contact portions of the intermediate transfer belt 50 and each photoconductor 21 form a primary transfer nip for transferring a toner image from the photoconductors 21 for each color to the intermediate transfer belt 50. The photoconductor cleaner 23 is configured to collect the toner having been not transferred to the intermediate transfer belt 50 and remaining on the corresponding photoconductor 21.

As shown in FIG. 1, the charger 22 is illustrated as a roller-shaped charging type, but the present invention is not limited to this. As another example, a charger of a corona charging type, a blade-shaped charging element, or a brush-shaped charging element or the like may be used. Further, the photoconductor cleaner 23 is illustrated as a plate-shaped cleaner, which is placed with its one end portion resting on the outer circumferential surface of the photoconductor 21, but the present invention is not limited to this. As still another example, cleaning members such as a fixed brush, a rotating brush, a roller, may be used alone or in combination. In another example of using a cleaner-less type in which the residual toner on the photoconductor 21 is collected by the developing roller 31, the photoconductor cleaner 23 may be omitted.

Further, above the intermediate transfer belt 50 in FIG. 1, hoppers 13Y, 13M, 13C, and 13K respectively storing toners of yellow, magenta, cyan, and black are provided. The toners stored in these hoppers are appropriately supplied to the corresponding accommodation parts 32 of the image forming sections 10.

At a position downstream of the image forming section 10K and upstream of the transfer nip N1 in a rotating direction of the intermediate transfer belt 50, density sensors 40 and 41 are provided to detect image density of a toner image transferred onto the intermediate transfer belt 50. The density sensors 40 and 41 are positioned to aim at different detecting points on the outer circumferential surface of the intermediate transfer belt 50.

For example, each of the density sensors 40 and 41 is provided with a light projecting part to irradiate a detecting point with light and a light receiving part to receive reflection light from the detecting point. Thus, when the toner image passes through the detecting points, the toner density representing a toner application amount of that toner image can be detected and output. The density sensors 40 and 41 are disposed to be apart from each other in a width direction (a depth direction in FIG. 1) of the intermediate transfer belt 50. Thus, the density sensors 40 and 41 are enabled to detect toner density of the toner image carried on the intermediate transfer belt 50 at different positions in the width direction of the intermediate transfer belt 50.

In a lower part of the image forming apparatus 1, a sheet feeding cassette 71 is mounted in a detachable manner. From a right side of the sheet feeding cassette 71, a sheet feeding passage 70 is provided to extend upward in FIG. 1. Paper sheets ("sheets") P stacked in the sheet feeding cassette 71 are to be fed one by one from the topmost one to the sheet feeding passage 70 by a sheet feeding roller 72.

On the sheet feeding passage 70 into which a sheet P is fed by the sheet feeding roller 72, a pair of paper stop rollers (resist rollers) 73, the transfer nip N1, a fixing unit 80, and a ejecting roller 74 are arranged in this order from an upstream side. On a further downstream side of the sheet feeding passage 70, the image forming apparatus 1 is further provided on its top surface with a sheet output section 75. The paper stop rollers 73 are configured to adjust a timing of delivering the sheet P to the transfer nip N1.

The fixing unit 80 includes a heating roller 82 to be heated by a heating section 83 and a pressurizing roller 81 pressed against the heating roller 82 from a direction perpendicular to an axis of the heating roller 82. The fixing unit 80 is configured to heat and press the sheet P at a fixing nip N2 to fix a toner image transferred to the sheet P.

Figure 2:
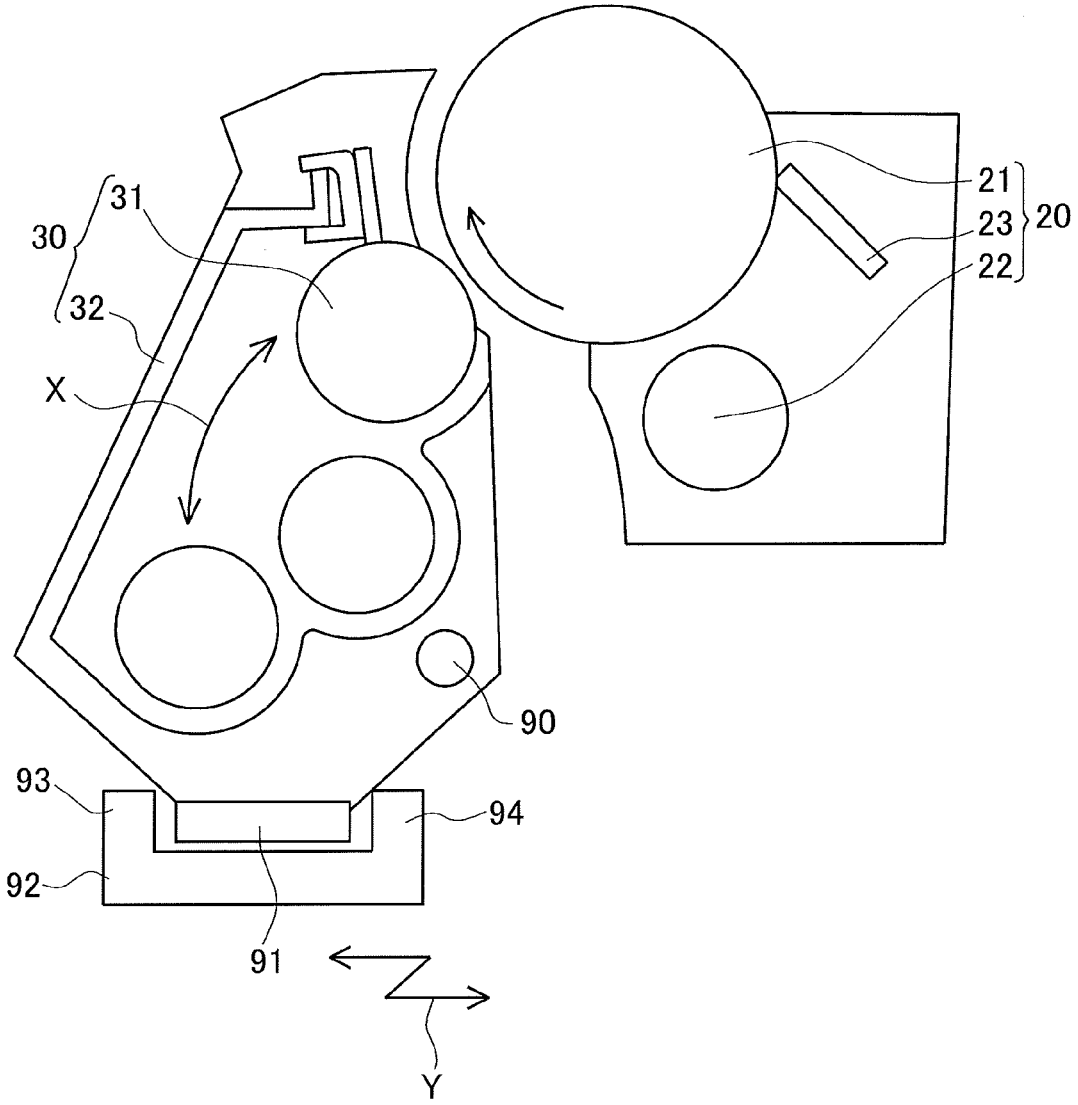
FIG. 2 is a schematic configuration view of a drum unit and a developing unit in the embodiments.

Herein, in each of the image forming sections 10Y, 10M, 10C, and 10K of the present embodiment, the photoconductor 21, the charger 22, and the photoconductor cleaner 23 are unitized to constitute a drum unit 20. Further, the developing roller 31 and the accommodation part 32 are unitized to constitute a developing unit 30. FIG. 2 shows the drum unit 20 and the developing unit 30 of the present embodiment.

As shown in FIG. 2, in each of the image forming sections 10Y, 10M, 10C, and 10K, the developing unit 30 is provided to be rotatable in a direction indicated with an arrow X about a spindle 90. Further, under the developing unit 30 in FIG. 2, a press and separation part 92 is provided. The press and separation part 92 is movable in a right and left direction as indicated with an arrow Y in FIG. 2.

Between a protrusion 93 on a left side of the press and separation part 92 and a protrusion 94 on a right side, a pressed part 91 of the developing unit 30 is placed. Therefore, the developing unit 30 is rotated about the spindle 90 in association with a motion of the press and separation part 92. Specifically, when the press and separation part 92 moves leftward in FIG. 2, the pressed part 91 is pushed by the protrusion 94 to rotate the developing unit 30 clockwise. On the other hand, when the press and separation part 92 moves rightward in FIG. 2, the press part 91 is pushed by the protrusion 93 to rotate the developing unit 30 counterclockwise. In other words, when the press and separation part 92 moves leftward and rightward, the developing unit 30 is switched its position between a press-contact position in which the developing roller 31 is pressed against the photoconductor 21 and a separated position in which the developing roller 31 is placed apart from the photoconductor 21.

In the present embodiment, the drum unit 20 of each of the image forming sections 10Y, 10M, 10C, and 10K is configured to be replaced with a new drum unit 20 after the end of useful lifetime of the photoconductor 21, for example. When the drum unit 20 is to be replaced with a new one, the press and separation part 92 moves the developing unit 30 to the separated position. Thus, the old drum unit 20 is detached from the image forming section 1 and a new drum unit 20 can be mounted in the image forming section 1 without interfering the drum unit 20 with the developing unit 30.

Further, the press and separation part 92 moves the developing unit 30 to the press-contact position in image forming. Thus, during image forming, the toner is allowed to appropriately transfer from the developing roller 31 to the photoconductor 21 to press-contact therewith. The press and separation parts 92 may be operated synchronously in all the image forming sections 10Y, 10M, 10C, and 10K or may be operated separately in the image forming sections 10Y, 10M, 10C, and 10K.

Now, one example of a normal image forming operation by the image forming apparatus 1 of the present embodiment is briefly explained. The following explanation is one example of the image forming operation in a case that a color image formed by toners of four colors is formed on the sheet P which is loaded on the sheet feeding cassette 71.

In forming a color image, firstly, the intermediate transfer belt 50 and each photoconductor 21 are rotated at a predetermined rotation speed in directions indicated with the arrows in FIG. 1. The outer circumferential surface of each photoconductor 21 is uniformly charged by the charger 22. The thus charged outer circumferential surface of the photoconductor 21 is subjected to light exposure according to an image data by the exposing unit 11, and thus an electrostatic latent image is formed. Subsequently, the electrostatic latent image is developed by the developing roller 31 to form a toner image on the photoconductor 21.

The toner images formed in respective colors on the photoconductors 21 are transferred in turn onto the intermediate transfer belt 50 by the corresponding primary transfer rollers 12 (primary transfer), so that the toner images of yellow, magenta, cyan, and black are overlapped in this order on the intermediate transfer belt 50. The thus overlapped four-colored toner image is conveyed to the transfer nip N1 by rotation of the intermediate transfer belt 50. Further, residual toner having been not transferred to the intermediate transfer belt 50 and remaining on the photoconductors 21 after passing through the primary transfer rollers 12 is scraped by the photoconductor cleaners 23 and removed from the photoconductors 21.

The sheets P loaded in the sheet feeding cassette 71 are taken out one by one from the topmost one to the sheet feeding passage 70. Each picked sheet P is conveyed through the sheet feeding passage 70 into the transfer nip N1. A timing of the sheet P entering in the transfer nip N1 is adjusted by the paper stop rollers 73 such that the timing coincides with an entering timing of the toner image on the intermediate transfer belt 50 into the transfer nip N1. As a result, the overlapped four-colored toner image is transferred onto the sheet P in the transfer nip N1 (secondary transfer).

The sheet P transferred with the toner image is further conveyed to a downstream side of the sheet feeding passage 70. Specifically, the toner image on the sheet P is fixed by the fixing unit 80, and subsequently this sheet P is ejected to the sheet output section 75 by the ejecting roller 74. The residual toner remaining on the intermediate transfer belt 50 after having passed through the transfer nip N1 is collected by the belt cleaner 61. Thus, the residual toner is removed from the intermediate transfer belt 50.

Figure 3:
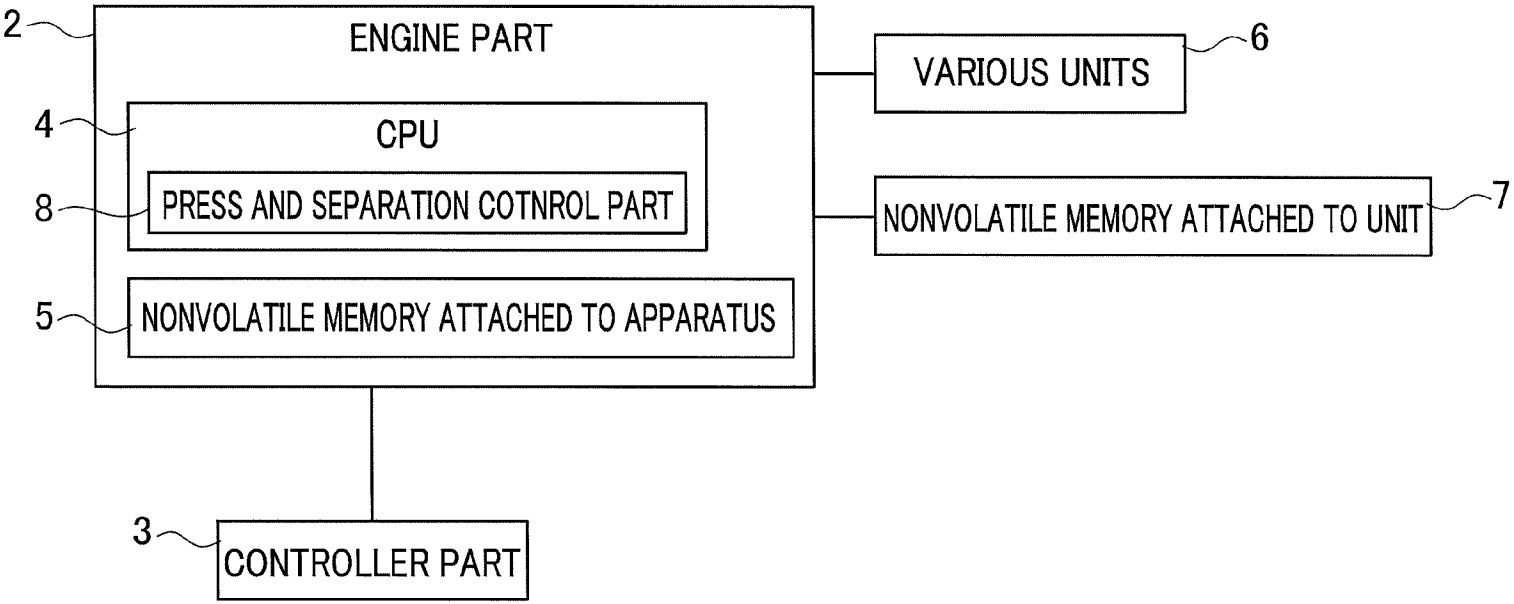
FIG. 3 is a schematic block diagram showing a control configuration of the image forming apparatus in the embodiments.

FIG. 3 is a block diagram schematically showing a control configuration of the image forming apparatus 1. The image forming apparatus 1 includes an engine part 2 and a controller part 3 for controlling each section of the apparatus. The engine part 2 includes a CPU 4 for performing the overall control processing and a nonvolatile memory 5 attached to the apparatus.

The nonvolatile memory 5 stores various values such as a value for performing image forming in the image forming apparatus 1. For example, the nonvolatile memory 5 stores values such as a system speed for conveying a sheet P and the formed toner image.

The CPU 4 controls each section of the image forming apparatus 1 based on the values stored in the nonvolatile memory 5. For example, the CPU 4 adjusts a start timing of forming an electrostatic latent image by each exposing unit 11 so that a colored toner image is formed on the intermediate transfer belt 50 with no misalignment. Further, the CPU 4 adjusts both the timing of forming an image by the image forming sections 10Y, 10M, 10C, and 10K and the timing of feeding the sheet P from the sheet feeding cassette 71 so that the timing of the image forming meets the entering timing of the sheet P in the transfer nip N1. Further, the CPU 4 includes a press and separation control part 8. This press and separation control part 8 is configured to control operation of the press and separation part 92.

The engine part 2 is configured to control various units 6 provided in the image forming apparatus 1 and to write and read data to and from a nonvolatile memory 7 attached to each of the various units. The various units 6 include, for example, the drum unit 20. As for the nonvolatile memory 7 attached to the various units, a memory attached to the drum unit 20 is, for example, stored with the number of sheets on which image forming is performed by that drum unit 20.

The controller part 3 is connected to an external personal computer or the like to receive input commands. Specifically, when the controller part 3 receives an image forming command, the image forming apparatus 1 takes a job of image forming. Further, the engine part 2 and the controller part 3 communicate various information such as a dot counter value between each other.

Further, as mentioned above, the image forming apparatus 1 is configured such that each drum unit 20 is replaceable. In the present embodiment, the drum unit 20 mounted in the image forming section 10K for forming a black-colored toner image is slightly different from the other drum units 20 in the image forming sections 10Y, 10M, and 10C for forming the toner images of yellow, magenta, and cyan. In the following explanation, when the drum units 20 of yellow, magenta, cyan, and black are individually specified, these drum units 20 are indicated as drum units 20Y, 20M, 20C, and 20K.

In general, a black-colored toner image is likely to be formed more frequently than toner images with other colors. Therefore, in the present embodiment, the drum unit 20K for black is designed to have life expectancy and others different from the drum units 20Y, 20M, and 20C for other colors. In other words, in the present embodiment, the drum units 20Y, 20M, and 20C with colors other than black have the same configuration. Only the drum unit 20K for black has the different configuration from the drum units 20Y 20M, and 20C for other colors.

Accordingly, it is unfavorable that any one of the drum units 20Y, 20M, and 20C with colors other than black is mounted in the image forming section 10K for black. On the contrary, it is also unfavorable that the drum unit 20K for black is mounted in any one of the image forming sections 10Y, 10M, and 10C for the colors other than black. When such wrong attachment occurs, the image forming apparatus 1 is not appropriately controlled, leading to deterioration in quality of a formed image and causing breakage.

To address the above problem, the image forming apparatus 1 of the present embodiment is designed to properly inform a user when the drum unit 20 is erroneously mounted as mentioned above. Specifically, in the image forming section 10 which is mounted with the wrong drum unit 20, a toner image is not made to be formed with a proper toner density. The following description is given to explain this point. In the present embodiment, only the drum unit 20K for black is configured differently from the drum units 20Y, 20M, and 20C for other colors as mentioned above. Accordingly, in the following explanation, detailed explanation is given only to the image forming section 10K for black and the image forming section 10Y for yellow.

Figure 4:
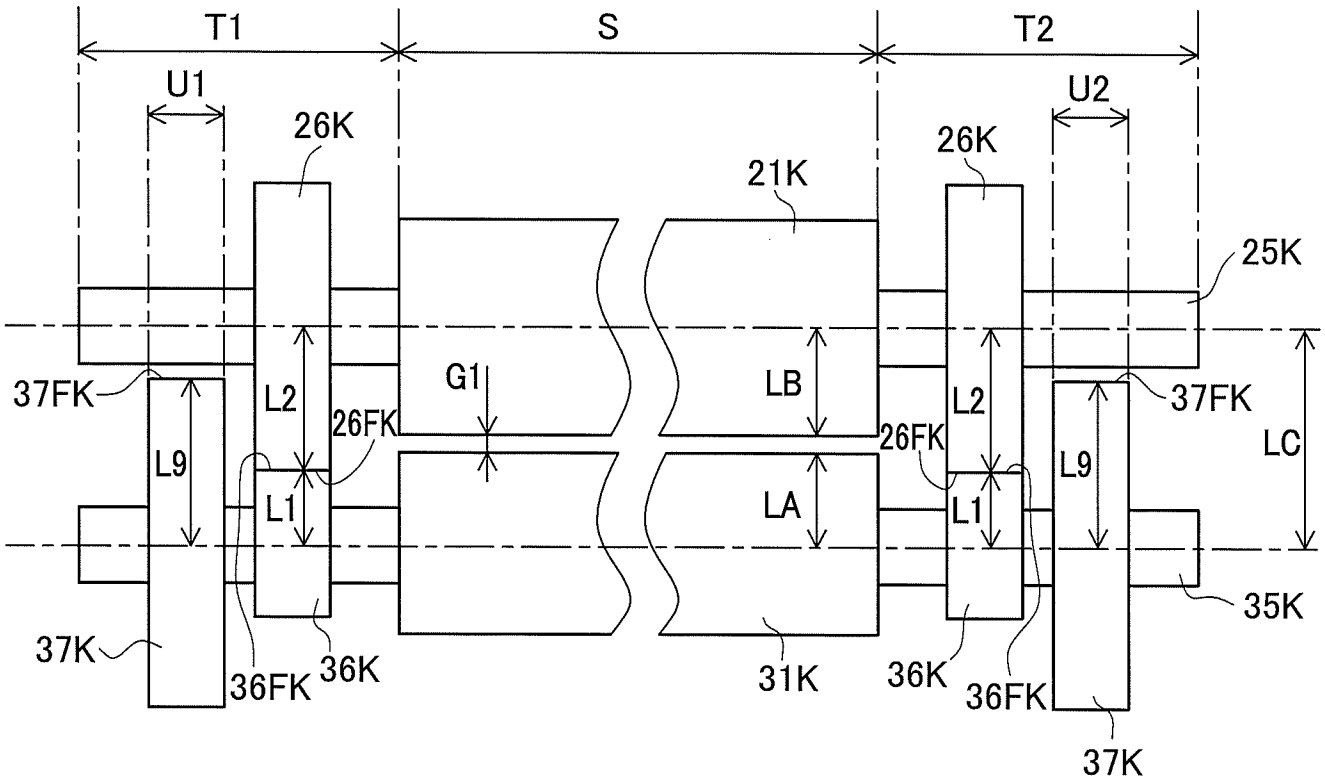
FIG. 4 is a diagram showing a press-contact state of a photoconductor and a developing roller of an image forming section for black in a first embodiment.
Figure 5:
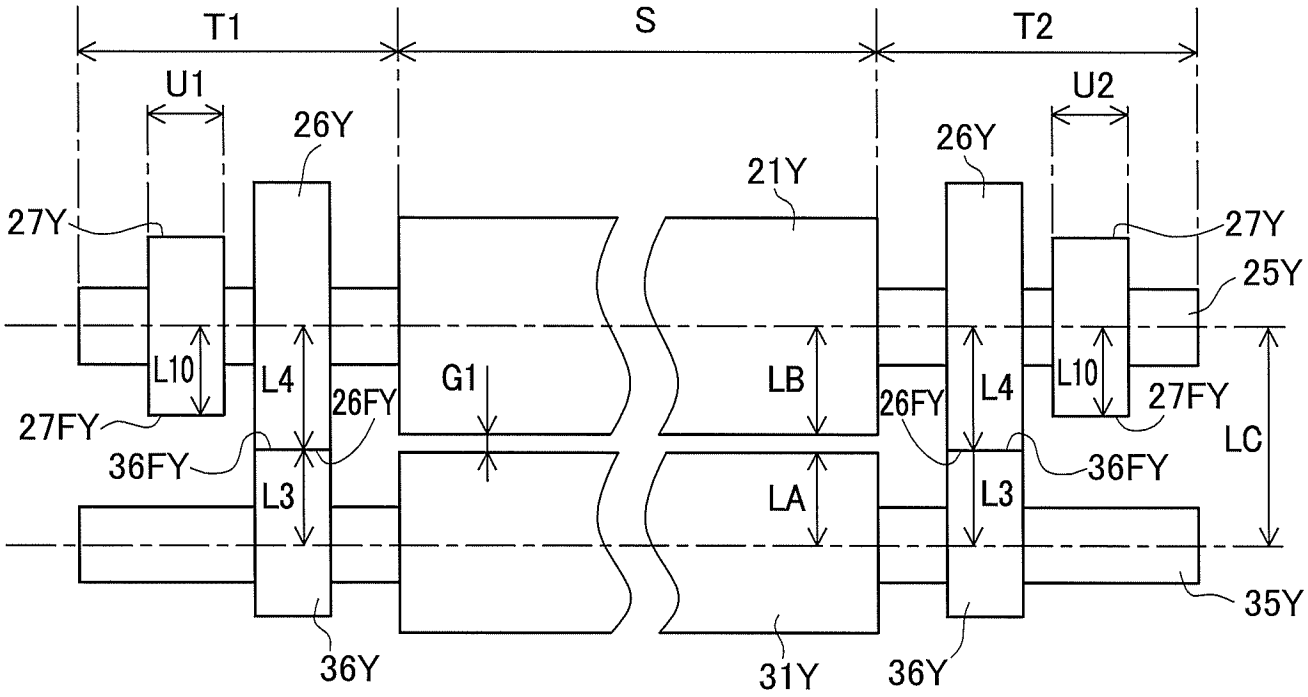
FIG. 5 is a diagram showing a press-contact state of a photoconductor and a developing roller of an image forming section for yellow in the first embodiment.

FIG. 4 shows the photoconductor 12 and the developing roller 31 in the image forming section 10K, and FIG. 5 shows the photoconductor 21 and the developing roller 31 in the image forming section 10Y. FIG. 4 shows a normal state in which the drum unit 20K for black is appropriately mounted in the image forming section 10K for black. FIG. 5 shows a normal state in which the drum unit 20Y for yellow is appropriately mounted in the image forming section 10Y for yellow.

Further, both FIGS. 4 and 5 show a state in which the developing unit 30 is in a press-contact position. In other words, the figures show a state in which the developing roller 31 is press-contacted with the photoconductor 21. In FIG. 4, each element of the image forming section 10K is assigned with reference signs appended with a suffix "K." Similarly, in FIG. 5, each element of the image forming section 10Y is assigned with reference signs appended with a suffix "Y."

As shown in FIG. 4, the photoconductor 21K is provided in an axial center of a photoconductor shaft 25K, and the developing roller 31K is provided in an axial center of a developing shaft 35K. Therefore, the photoconductor 21K and the developing roller 31K face each other in a center region S. In the present embodiment, the center region S corresponds to a toner image forming region in which the black toner is applied from the developing roller 31K to the photoconductor 21K in image forming.

Further, the developing shaft 35K is provided with a first pressure receiving part 36K in each of a first outer region T1 located on a left side next to the center region S and a second outer region T2 located on a right side in the figure. Moreover, the photoconductor shaft 25K is provided with a second pressure receiving part 26K in each of the first outer region T1 and the second outer region T2.

The first pressure receiving part 36K has a first pressure receiving surface 36FK contacted with the second pressure receiving part 26K in the press-contact state as shown in FIG. 4. Further, the second pressure receiving part 26K has a second pressure receiving surface 26FK contacted with the first pressure receiving part 36K. In other words, the first pressure receiving part 36K and the second pressure receiving part 26K constitute a pressure receiving part pair contacted each other in the press-contact state.

In FIG. 4, a distance from a central axis of the developing roller 31K (the developing shaft 35K) to the first pressure receiving surface 36FK of the first pressure receiving part 36K is defined as a protruding distance L1 of the first pressure receiving part 36K. Further, a distance from a central axis of the photoconductor 21K (the photoconductor shaft 25K) to the second pressure receiving surface 26FK of the second pressure receiving part 26K is defined as a protruding distance L2 of the second pressure receiving part 26K. As shown in FIG. 4, a sum of the protruding distance L1 and the protruding distance L2 is defined as an inter-axis distance LC between central axes of the photoconductor 21K and the developing roller 31K.

The total distance of the protruding distance L1 and the protruding distance L2 is set longer than a sum of a radius LA of the developing roller 31K and a radius LB of the photoconductor 21K. Therefore, in the press-contact state, a clearance or gap G1 is created between the photoconductor 21K and the developing roller 31K. The clearance G1 in the present embodiment is, for example, designed to be about 0.3 mm.

Figure 6:
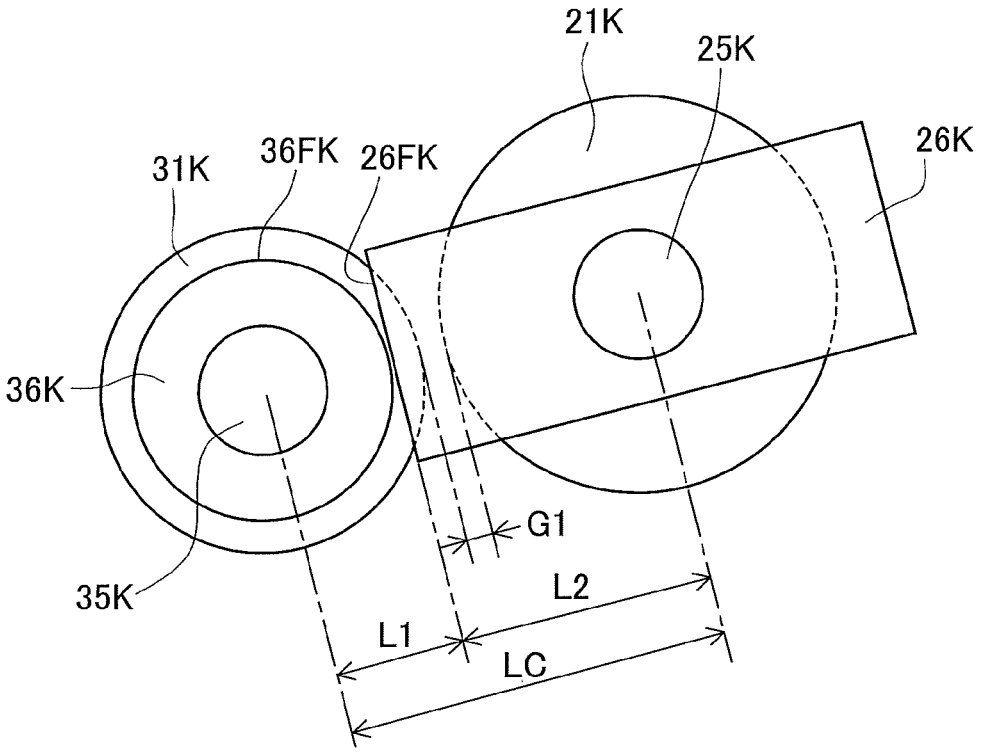
FIG. 6 is a sectional view showing the press-contact state of the photoconductor and the developing roller of the image forming section for black in the first embodiment.

FIG. 6 shows a sectional view of the first pressure receiving part 36K and the second pressure receiving part 26K taken along a plane perpendicular to an axial direction of the developing shaft 35K. The first pressure receiving part 36K in the present embodiment is cylindrically shaped, and an outer circumferential surface of the first pressure receiving part 36K constitutes the first pressure receiving surface 36FK. On the other hand, the second pressure receiving part 26K in the present embodiment is formed in a rectangular-parallelepiped shape oriented with its long sides extending from the photoconductor shaft 25K to the developing shaft 35K. A side surface of the second pressure receiving part 26K, located on a side close to the developing shaft 35K, constitutes the second pressure receiving surface 26FK.

In the present embodiment, the first pressure receiving part 36K is formed as a radial bearing and the second pressure receiving part 26K is made of resin. Further, the second pressure receiving part 26K is held on the photoconductor shaft 25K so that the second pressure receiving part 26K is not rotated with the second pressure receiving surface 26FK facing the developing shaft 35K even when the photoconductor 21K is rotated. Thus, the first pressure receiving part 36K and the second pressure receiving part 26K contacted each other in the press-contact state do not cause resistance to the rotation of the photoconductor 21K and the developing roller 31K in image forming. Furthermore, the inter-axis distance LC and the clearance G1 are maintained unchanged even when the photoconductor 21K and the developing roller 31K are rotated.

Further, as shown in FIG. 4, the developing shaft 35K is provided with first protection parts 37K. Specifically, the first protection parts 37K are provided in a first protection region U1 and a second protection region U2 located respectively in the first outer region T1 and the second outer region T2. The first protection region U1 and the second protection region U2 are each located in different positions from the first pressure receiving part 36K in the first outer region T1 and the second pressure receiving part 26K in the second outer region T2. Each of the first protection parts 37K has a cylindrical shape having a radius L9 as indicated in FIG. 4. Herein, an outer circumferential surface 37FK of the first protection part 37K does not contact any elements in a normal state shown in FIG. 4.

Next, a configuration of the image forming section 10Y is explained with reference to FIG. 5. As shown in FIG. 5, in the image forming section 10Y, similarly to the above, the photoconductor 21Y and the developing roller 31Y are each provided in a center region S located in an axial center of a photoconductor shaft 25Y and a developing shaft 35Y to face each other, that is, to extend in parallel with each other. In FIG. 5, too, the center region S corresponds to a toner image forming region in which a yellow toner is applied from the developing roller 31Y to the photoconductor 21Y in image forming.

Further, third pressure receiving parts 36Y are each provided on the developing shaft 35Y in a first outer region T1 and a second outer region T2. Moreover, fourth pressure receiving parts 26Y are each provided on the photoconductor shaft 25Y in the first outer region T1 and the second outer region T2. A third pressure receiving surface 36FY of the third pressure receiving part 36Y is contacted with the fourth pressure receiving part 26Y in the press-contact state. Furthermore, a fourth pressure receiving surface 26FY of the fourth pressure receiving part 26Y is contacted with the third pressure receiving part 36Y in the press-contact state. In short, the third pressure receiving part 36Y and the fourth pressure receiving part 26Y constitute a pressure receiving part pair contacted each other in the press-contact state.

Further, in FIG. 5, a distance from a central axis of the developing roller 31Y (the developing shaft 35Y) to the third pressure receiving surface 36FY is defined as a protruding distance L3 of the third pressure receiving part 36Y, and a distance from a central axis of the photoconductor 21Y (the photoconductor shaft 25Y) to the fourth pressure receiving surface 26FY is defined as a protruding distance L4 of the fourth pressure receiving part 26Y. In the present embodiment, a sum of the protruding distance L3 and the protruding distance L4 is set equal to the sum of the protruding distance L1 and the protruding distance L2 indicated in FIG. 4. In other words, an inter-axis distance LC which is a total distance of the protruding distance L3 and the protruding distance L4 is equal to that in FIG. 4. Further, a radius LA of the developing roller 31Y and a radius LB of the photoconductor 21Y are equal to those in FIG. 4. Accordingly, as shown in FIG. 5, the photoconductor 21Y and the developing roller 31Y in the press-contact state has a clearance G1 as similar to the configuration in FIG. 4.

Further, the third pressure receiving part 36Y and the fourth pressure receiving part 26Y respectively have similar cross sections taken along a plane perpendicular to an axial direction of the developing shaft 35Y to the first pressure receiving part 36K and the second pressure receiving part 26K shown in FIG. 6. In the present embodiment, the third pressure receiving part 36Y is a radial bearing and the fourth pressure receiving part 26Y is made of resin. The fourth pressure receiving part 26Y is held on the photoconductor shaft 25Y so that the fourth pressure receiving part 26Y is not rotated with the fourth pressure receiving surface 26FY facing the developing shaft 35Y even when the photoconductor 21Y is rotated. Thus, the third pressure receiving part 36Y and the fourth pressure receiving part 26Y contacted each other in the press-contact state do not cause resistance to the rotation of the photoconductor 21Y and the developing roller 31Y in image forming. Furthermore, the inter-axis distance LC and the clearance G1 are maintained unchanged even when the photoconductor 21K and the developing roller 31K are rotated.

As shown in FIG. 5, the photoconductor shaft 25Y is provided with second protection parts 27Y. Specifically, the second protection parts 27Y are provided one in each of the first protection region U1 and the second protection region U2 as similar to the configuration in FIG. 4. In other words, the first protection part 37K in FIG. 4 and the second protection part 27Y in FIG. 5 are located to be overlapped in an axial position. Each of the second protection parts 27Y is also cylindrically shaped and has a radius L10 as indicated in FIG. 5. Herein, an outer circumferential surface 27FY of the second protection part 27Y does not contact with any elements in the normal state shown in FIG. 5.

In the pressure receiving part pair of the present embodiment, the protruding distance L1 of the first pressure receiving part 36K is designed to be smaller than the protruding distance L3 of the third pressure receiving part 36Y. Further, the protruding distance L2 of the second pressure receiving part 26K is designed to be larger than the protruding distance L4 of the fourth pressure receiving part 26Y To be specific, a difference between the protruding distance L1 and the protruding distance L3 and a difference between the protruding distance L2 and the protruding distance L4 are each about 1 mm. Even when a wrong drum unit 20 is mounted as mentioned above, therefore, this dimensional relation of the pressure receiving part pairs enables to appropriately make a user aware of such attachment of the wrong drum unit.

Further, a sum of the radius L9 of the first protection part 37K (FIG. 4) and the radius L10 of the second protection part 27Y (FIG. 5) is set to be at least larger than the sum of the radius LA of the developing roller 31K and the radius LB of the photoconductor 21Y. Moreover, in the present embodiment, the sum of the radius L9 of the first protection part 37K and the radius L10 of the second protection part 27Y is set to be larger than the inter-axis distance LC. Thus, breakage of the image forming section 10 is prevented in a case that the drum unit 20 is wrongly mounted.

Figure 7:
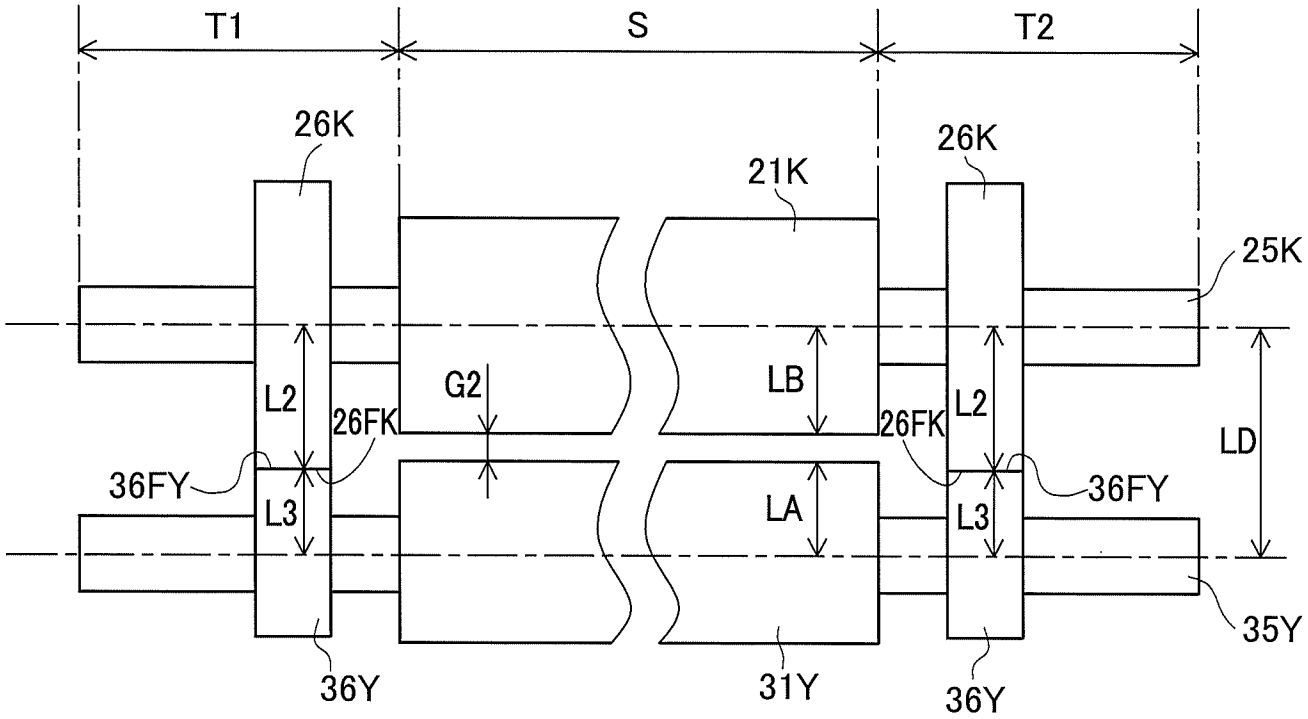
FIG. 7 is a diagram showing a press-contact state of the photoconductor and the developing roller when a drum unit for black is erroneously mounted in the image forming section for yellow in the first embodiment.

Next, examples in which the drum units 20Y and 20K are wrongly mounted are explained in detail with reference to FIGS. 7 and 8. FIG. 7 shows the photoconductor 21K and the developing roller 31Y in a case that the drum unit 20K for black is wrongly mounted in the image forming section 10Y for yellow. FIG. 7 shows the press-contact state of the photoconductor 21K and the developing roller 31Y. In the press-contact state shown in FIG. 7, the third pressure receiving parts 36Y and the second pressure receiving parts 26K are contacted in the first outer region T1 and the second outer region T2.

Based on the dimensional relation of the pressure receiving part pairs mentioned above, the protruding distance L2 of the second pressure receiving part 26K is larger than the protruding distance L4 of the fourth pressure receiving part 26Y which constitutes, in combination with the third pressure receiving part 36Y, the pressure receiving part pair in the normal state of the image forming section 10Y (FIG. 5). Further, the protruding distance L3 of the third pressure receiving part 36Y is larger than the protruding distance L1 of the first pressure receiving part 36K which constitutes the pressure receiving part pair with the second pressure receiving part 26K in the normal state of the image forming section 10K (FIG. 4).

Accordingly, when the drum unit 20K is wrongly mounted in the image forming section 10Y as shown in FIG. 7, an inter-axis distance LD between the photoconductor 21K and the developing roller 31Y is larger than the inter-axis distance LC in the normal state. Furthermore, in this wrong attachment state in FIG. 7 in which the inter-axis distance LD is large, a clearance G2 between the photoconductor 21K and the developing roller 31Y also becomes larger than the normal clearance G1.

Typically, toner density of a formed toner image varies according to changes in the gap distance between the photoconductor 21 and the developing roller 31. Specifically, the larger the clearance between the photoconductor 21 and the developing roller 31 becomes, the less toner is moved from the developing roller 31 to the photoconductor 21, so that the toner density of the formed toner image is likely to be low.

In the state shown in FIG. 7 in which the drum unit 20K is wrongly mounted in the image forming section 10Y, the clearance G2 is made larger than the normal clearance G1, so that a resultant formed toner image has low density. Namely, when a yellow-colored toner image is formed by the image forming section 10Y in which the drum unit 20K is wrongly mounted, an image fixed on the sheet P with the yellow toner image is lower in density than the normal yellow density. Then, a user becomes aware of the resultant output image having lower yellow density than in the normal state, and thereby notices that the image forming section 10Y is being mounted with the wrong drum unit 20K.

Figure 8:
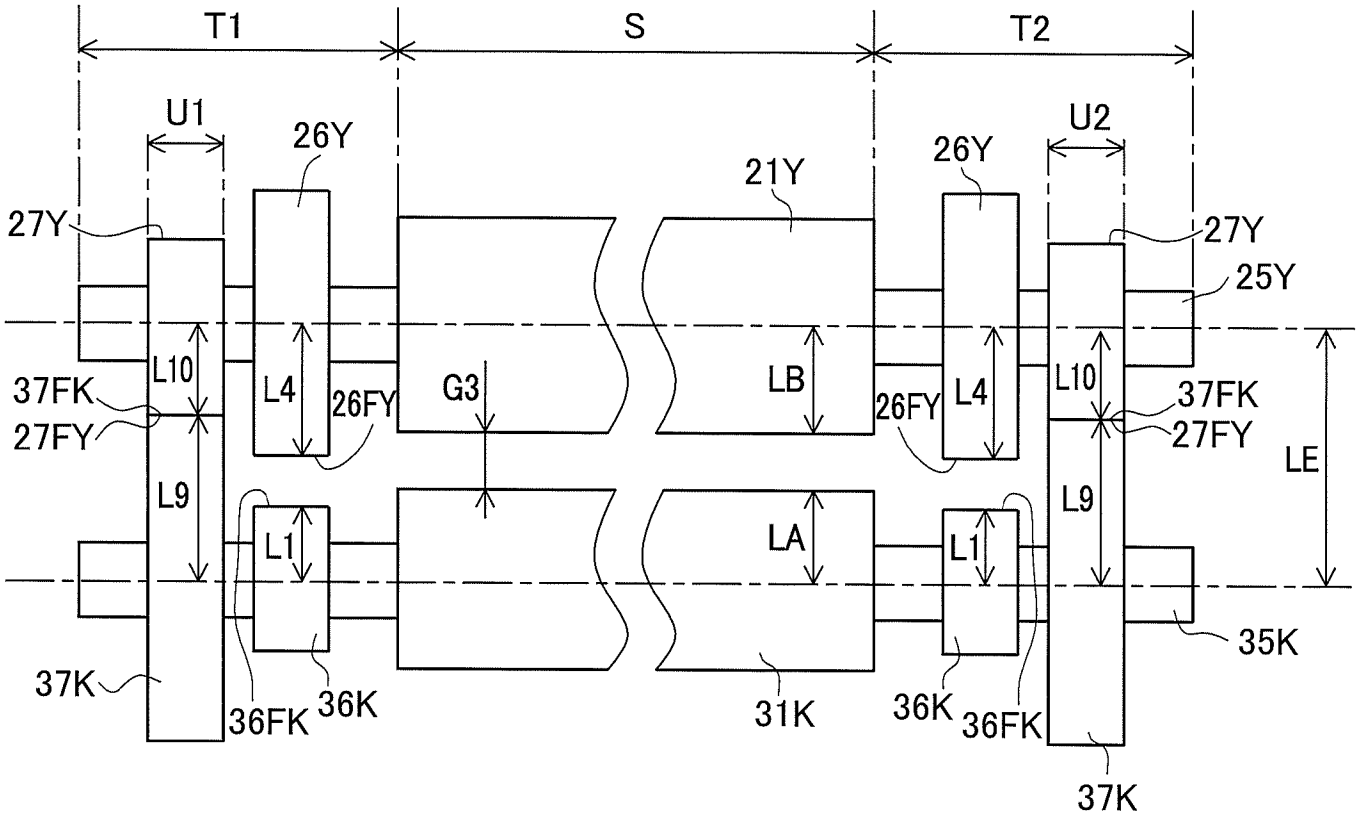
FIG. 8 is a diagram showing a press-contact state of the photoconductor and the developing roller when a drum unit for yellow is erroneously mounted in the image forming section for black in the first embodiment.

FIG. 8 shows the photoconductor 21Y and the developing roller 31K in a case that the drum unit 20Y is mounted in the image forming section 10K. In FIG. 8, too, the photoconductor 21Y and the developing roller 31K are in the press-contact state. However, in the present embodiment, the first pressure receiving parts 36K and the fourth pressure receiving parts 26Y in the first outer region T1 and in the second outer region T2 are not contacted with each other in the press-contact state of the photoconductor 21Y and the developing roller 31K as shown in FIG. 8. On the other hand, in the first protection region U1 in the first outer region T1 and in the second protection region U2 in the second outer region T2, the first protection parts 37K and the second protection parts 27Y are contacted.

Based on the dimensional relation of the pressure receiving part pairs mentioned above, the protruding distance L1 of the first pressure receiving part 36K is smaller than the protruding distance L3 of the third pressure receiving part 36Y which constitutes, in combination with the fourth pressure receiving part 26Y, the pressure receiving part pair in the normal state of the image forming section 10Y (FIG. 5). Further, the protruding distance L4 of the fourth pressure receiving part 26Y is smaller than the protruding distance L2 of the second pressure receiving part 26K which constitutes, in combination with the first pressure receiving part 36K, the pressure receiving part pair in the normal state of the image forming section 10K (FIG. 4).

Accordingly, the sum of the protruding distance L1 of the first pressure receiving part 36K and the protruding distance L4 of the fourth pressure receiving part 26Y is smaller than the inter-axis distance LC in the normal state. If the sum of the protruding distance L1 and the protruding distance L4 is smaller than the sum of the radius LA of the developing roller 31K and the radius LB of the photoconductor 21Y, the photoconductor 21Y and the developing roller 31K brought in the press-contact position could contact each other with no gap therebetween. Moreover, such a contact between the photoconductor 21Y and the developing roller 31K might cause their breakage.

To avoid such a defect, the first protection parts 37K and the second protection parts 27Y are provided in the present embodiment. As mentioned above, the sum of the radius L9 of the first protection part 37K and the radius L10 of the second protection part 27Y is set larger at least than the sum of the radius LA of the developing roller 31K and the radius LB of the photoconductor 21Y. Accordingly, in the present embodiment, the first protection parts 37K and the second protection parts 27Y are contacted in the first outer region T1 and the second outer region T2, thereby preventing the contact between the photoconductor 21Y with the developing roller 31K.

The first protection parts 37K and the second protection parts 27Y in the present embodiment are not so precisely formed in dimensions. This is because those protection parts are intended only to prevent contact between the photoconductor 21Y and the developing roller 31K. Further, the clearance G1 is not so large relative to the low dimensional precision of the first protection parts 37K and the second protection parts 27Y. Therefore, in the present embodiment, the sum of the radius L9 of the first protection part 37K and the radius L10 of the second protection part 27Y is set larger than the inter-axis distance LC in order to surely prevent the direct contact between the photoconductor 21Y with the developing roller 31K.

When the drum unit 20Y is wrongly mounted in the image forming section 10K as shown in FIG. 8, an inter-axis distance LE between the photoconductor 21Y and the developing roller 31K becomes larger than the inter-axis distance LC in the normal state. Further, in the wrong attachment state shown in FIG. 8, the inter-axis distance LE is large and thus a clearance G3 between the photoconductor 21Y and the developing roller 31K also becomes larger than the normal clearance G1.

In the state shown in FIG. 8 in which the drum unit 20Y is wrongly mounted in the image forming section 10K, the clearance G3 is made larger than the normal clearance G1, so that the formed toner image has low density. Namely, when a black-colored toner image is formed by the image forming section 10K in which the drum unit 20Y is wrongly mounted, an image fixed on the sheet P with the black toner image has the density lower than the normal black density. Thus, a user becomes aware of the resultant output image having lower black density than in the normal state, and thus notices that the wrong drum unit 20Y is being mounted in the image forming section 10K.

Incidentally, the sum of the radius L9 of the first protection part 37K and the radius L10 of the second protection part 27Y may be equal to the inter-axis distance LC. However, in that case, the user cannot notice that the drum unit 20Y is wrongly mounted in the image forming section 10K. On the contrary, as explained with FIG. 7, the user can be made aware of the wrong attachment when the drum unit 20K is wrongly mounted in the image forming section 10Y.

Further, the first protection part 37K and the second protection part 27Y are not necessarily essential elements for the present embodiment. To be specific, the protection parts are unnecessary when the sum of the protruding distance L1 of the first pressure receiving part 36K and the protruding distance L4 of the fourth pressure receiving part 26Y is larger than the sum of the radius LA of the developing roller 31K and the radius LB of the photoconductor 21Y. This is because in the press-contact state, the first pressure receiving part 36K and the fourth pressure receiving part 26Y are contacted, and therefore the developing roller 31K and the photoconductor 21Y are not contacted. Further in this case, a clearance between the developing roller 31K and the photoconductor 21Y is smaller than the normal clearance G1, so that an image is output with a higher black density than the normal density. From the image output with the higher black density than the normal density, the user can notice that the image forming section 10K is mounted with the wrong drum unit 20Y.

As mentioned above, the image forming apparatus 1 of the present embodiment is configured to output the color with the wrongly mounted toner at a state thinner than the normal density when the drum units 20K and 20Y are wrongly mounted in the image forming sections 10Y and 10K, so that the user can be made aware of the wrong attachment. The user who noticed the wrong attachment can replace the drum units 20Y and 20K which are wrongly mounted with correct ones. As a result, it is preventable to wrongly mount the drum units 20Y and 20K in the image forming sections 10Y and 10K.

Further, in the present embodiment, even when the drum units 20Y and 20K are wrongly mounted, components of the image forming apparatus 1 do not suffer from breakage. This is because the first pressure receiving part 36K and others are designed to have enough strength to receive a press-contact force in the normal press-contact state. Furthermore, the first protection parts 37K and the second protection parts 27Y also can be deigned in advance to have enough strength to endure the press-contact force in the press-contact state.

In the above configuration, when the drum units 20Y and 20K are wrongly mounted in the image forming sections 10Y and 10K respectively, the wrong attachment can be informed to a user by the density of the image formed on the sheet P. As one alternative for this, a display part may be provided in the image forming apparatus 1 to notify the user of the wrong attachment. In this case, the density sensors 40 and 41 can be used for detection of the wrong attachment in the image forming apparatus 1 of the present embodiment.

Specifically, for example, the image forming sections 10Y and 10K are operated to carry out a test control of forming a test pattern of a predetermined toner image. The predetermined test pattern may be determined to be formed at a position that passes through a detection point of at least one of the density sensors 40 or 41 which are located apart from each other with an interval in a width direction. Further, in the test control, the formed test pattern is detected by the density sensor(s) 40 and/or 41. When the toner density output by the density sensor(s) 40 and/or 41 is out of a predetermined allowable range of a toner density, it is determined that the wrong attachment occurs.

Further, when it is determined that the wrong attachment occurs, the display part provided in the image forming apparatus 1 may display the fact of wrong attachment. When the density sensor(s) 40 and/or 41 is used for detection of the wrong attachment, the CPU 4 is provided with a test control part for performing the above mentioned test control. Furthermore, the nonvolatile memory 5 is recorded with the predetermined test pattern, the allowable range of the toner density, and others.

Further, when it is determined by the test control that the wrong attachment occurs, a normal image forming operation by the image forming section 10 mounted with the wrong drum unit may be disallowed. As another alternative, when it is determined by the test control that the wrong attachment occurs, not only image forming by the image forming section 10 mounted with the wrong drum unit, but all the normal image forming operations may be disallowed.

Further, as mentioned above, the drum units 20Y, 20M, and 20C for yellow, magenta, cyan other than black have the similar configuration. Accordingly, the drum units 20M and 20C for magenta and cyan may be configured as similar to the drum unit 20Y for yellow. The developing rollers 31 for magenta and cyan may also be provided with elements similar to the third pressure receiving parts 36Y of the developing roller 31Y for yellow.

Therefore, in the image forming apparatus 1, the user can be notified that any one of the drum units 20Y, 20M, and 20C for yellow, magenta, and cyan is wrongly mounted in the image forming section 10K for black. Further, the user can also be notified that the drum unit 20K for black is wrongly mounted in any one of the image forming sections 10Y, 10M, and 10C for yellow, magenta, and cyan.

Even when the drum units 20 for yellow, magenta, cyan, and black have different configurations, as long as their dimensional relations are made as similar to the relation between the yellow drum unit and the black drum unit, the user can be notified with the wrong attachment. To be specific, each of the photoconductors 21 and the developing rollers 31 for each color may be provided with a pressure receiving part pair configured to make a clearance between the photoconductor 21 and the developing roller 31 different from the clearance G1 when the image forming section 10 is mounted with the drum unit 20 for different color. Further, when any one of the pressure receiving part pairs in wrong attachment has the sum of the protruding distances smaller than the sum of the radius LA and the radius LB, at least shafts of the pressure receiving parts may be respectively provided with an element similar to the first protection part 37K and the second protection part 27Y. When the pressure receiving part pair in wrong attachment has the sum of the protruding distances smaller than the inter-axis distance LC, it is preferable to provide elements similar to the first protection part 37K and the second protection part 27Y. As a result, the contact between the photoconductor 21 and the developing roller 31 can be surely prevented.

As mentioned above, the black-colored toner image tends to be formed frequently as compared with toner images with other colors. Therefore, among the drum units 20 for each color, the drum unit 20K for black has high frequency in replacement and thus is likely to have large distribution amount on the market. Accordingly, the possibility of wrongly mounting the drum unit 20K for black by the user is higher than the possibility of wrongly mounting the drum units 20Y, 20M, and 20C for other colors.

Therefore, when the drum units 20 for yellow, magenta, cyan, and black have configurations different from one another, it is preferable to make at least the pressure receiving part pair for black different from the pressure receiving part pairs for other colors. In short, it is preferable to make the user aware of the wrong attachment of the drum unit 20K to any one of the image forming sections 10Y, 10M, and 10C and to prevent the wrong attachment of the drum unit 20K.

Further, it is preferable that one of the pressure receiving parts provided in the photoconductor 21 and the developing roller 31 is adjustable with its protruding distance. This is because the clearance G1 between the photoconductor 21 and the developing roller 31 in the normal state can be adjusted in a manufacturing process of the drum unit 20 or the developing unit 30. Accordingly, in the present embodiment, it is conceivable that the second pressure receiving part 26K of the drum unit 20K for black is, for example, configured to be movable to come close to or apart from the developing roller 31K before fixation of the drum unit.

As explained in detail above, the image forming apparatus 1 of the present embodiment includes the image forming sections 10 configured to replace the drum units 20. Further, the photoconductors 21 and the developing rollers 31 include the pressure receiving part pairs, each pair being contacted each other in the press-contact state in the first outer region T1 and the second outer region T2. Further, the protruding distance L1 of the first pressure receiving part 36K of the developing roller 31K in the image forming section 10K is set smaller than the protruding distance L3 of the third pressure receiving part 36Y of the developing roller 31Y in the image forming section 10Y. The protruding distance L2 of the second pressure receiving part 26K of the photoconductor 21K in the image forming section 10K is set larger than the protruding distance L4 of the fourth pressure receiving part 26Y of the photoconductor 21Y in the image forming section 10Y. Therefore, an image forming apparatus can achieve prevention of breakage caused by wrong attachment in a replacement part and prevention of the wrong attachment, and a drum unit applicable to the replacement part of the image forming apparatus can be provided.

The present invention is exemplified with the above embodiment, but it is not limited to the above embodiment and may be naturally applied with various changes and modifications without departing from the scope of its subject matter. For example, the above embodiment is explained with an example that the drum unit 20 is replaceable. Alternatively, the present invention is naturally applicable to the configuration that the developing unit 30 is replaceable. In this case, an image forming apparatus can achieve prevention of breakage caused by wrong attachment in a replacement part and prevention of the wrong attachment, and a drum unit applicable to the replacement part of the image forming apparatus can be provided.

As another alternative, both the drum unit 20 and the developing unit 30 may be replaceable parts. Further, the dimensional relation of the protruding distances of the pressure receiving parts is not limited to the above embodiment. Namely, the pressure receiving part pair in the above embodiment may be switched between the photoconductor 21 and the developing roller 31. Further, for example, the drum unit 20 as a replacement part includes the charger 22 and others as well as the photoconductor 21 in the present embodiment. Alternatively, as the replacement part, the configuration may include at least the photoconductor 21 and the pressure receiving part on a side close to the photoconductor 21. Furthermore, the present invention is not limited to a color printer and is applicable to, for example, an image forming apparatus conducting transmission and reception of printing jobs through public lines.

Further, for example, other techniques of preventing wrong attachment may be applied in addition to the above embodiment. For example, a substrate recorded with color information is provided in the drum unit 20 and a reading part to read out the substrate's color information may be provided in the image forming sections 10 for each color.

Figure 9:
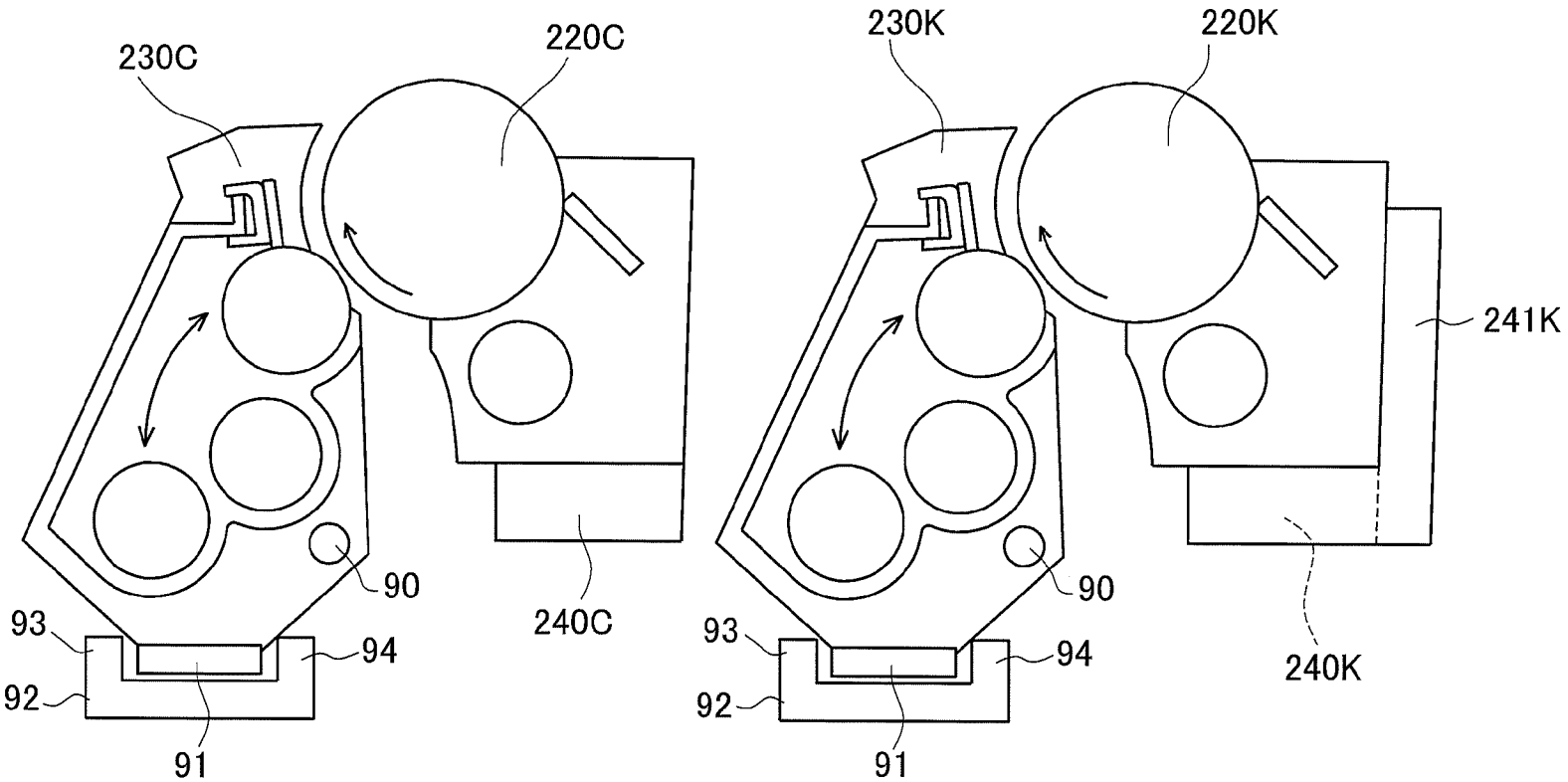
FIG. 9 is a schematic view illustrating an example of a drum unit provided with an interference part which is to interfere attachment of the drum unit to another image forming section for a different color.

Further alternatively, the drum unit 20 may be configured not to be mounted in the image forming section 10 for different color. As such a configuration, one example is shown in FIG. 9. FIG. 9 shows an image forming section 10C for cyan and an image forming section 10K for black which are adjacent to each other. FIG. 9 specifically shows a drum unit 220C and a developing unit 230C for cyan and a drum unit 220K and a developing unit 230K for black.

Figure 10:
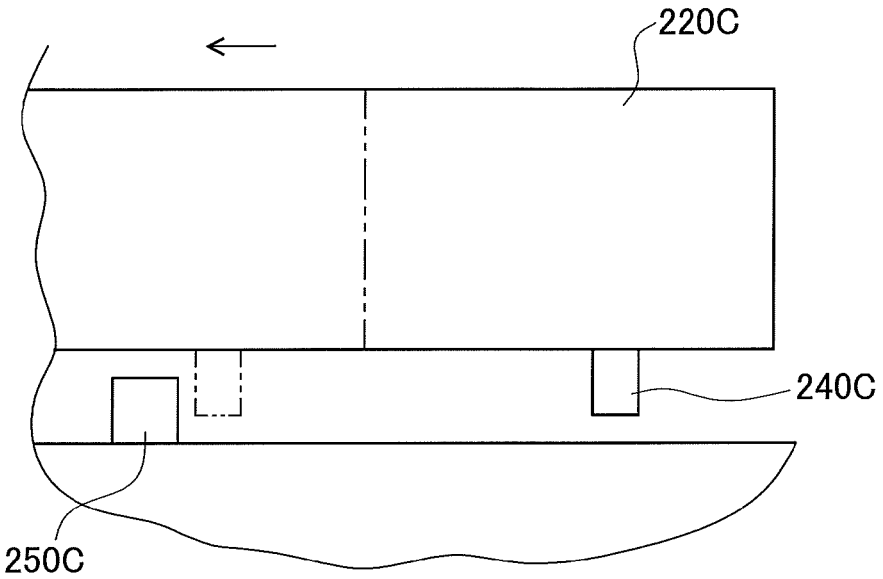
FIG. 10 is a side view of a drum unit which is not provided with the interference part.

As shown in FIG. 9, a stopper 240C is provided in a lower part of the drum unit 220C for cyan. FIG. 10 is a side view of the drum unit 220C. As indicated with an arrow in FIG. 10, the drum unit 220C is moved leftward and thus can be detached from the image forming apparatus. The stopper 240C is provided to be in contact with a stopper 250C on a side close to the image forming apparatus before the drum unit 220C is completely detached. The stopper 240C and the stopper 250C are configured to once stop movement of the drum unit 220C to be detached before completion of detachment and to prevent dropping or the like of the drum unit 220C. Therefore, this configuration enables to prevent a user's injury and breakage of the drum unit 220C.

Figure 11:
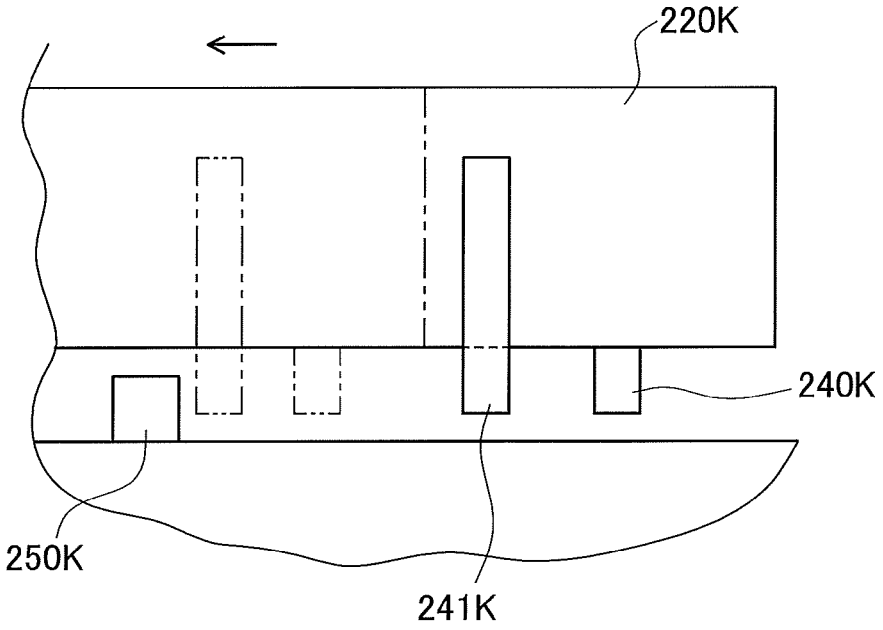
FIG. 11 is a side view of a drum unit which is provided with the interference part.

Further, a drum unit 220K for black is provided with a stopper 240K formed as similar to the stopper 240C in the drum unit 220C for cyan, and further provided with a stopper 241K as shown in FIG. 11. Both the stoppers 240K and 241K are placed to be in contact with a stopper 250K on a side close to the image forming apparatus as shown in FIG. 11 so that the stoppers 240K and 241K are brought into contact with the stopper 250K before the drum unit 220K is completely detached. The stopper 241K in the drum unit 220K is, as shown in FIG. 9, formed to extend from a lower part to a right-side surface of the drum unit 220K.

Figure 12:
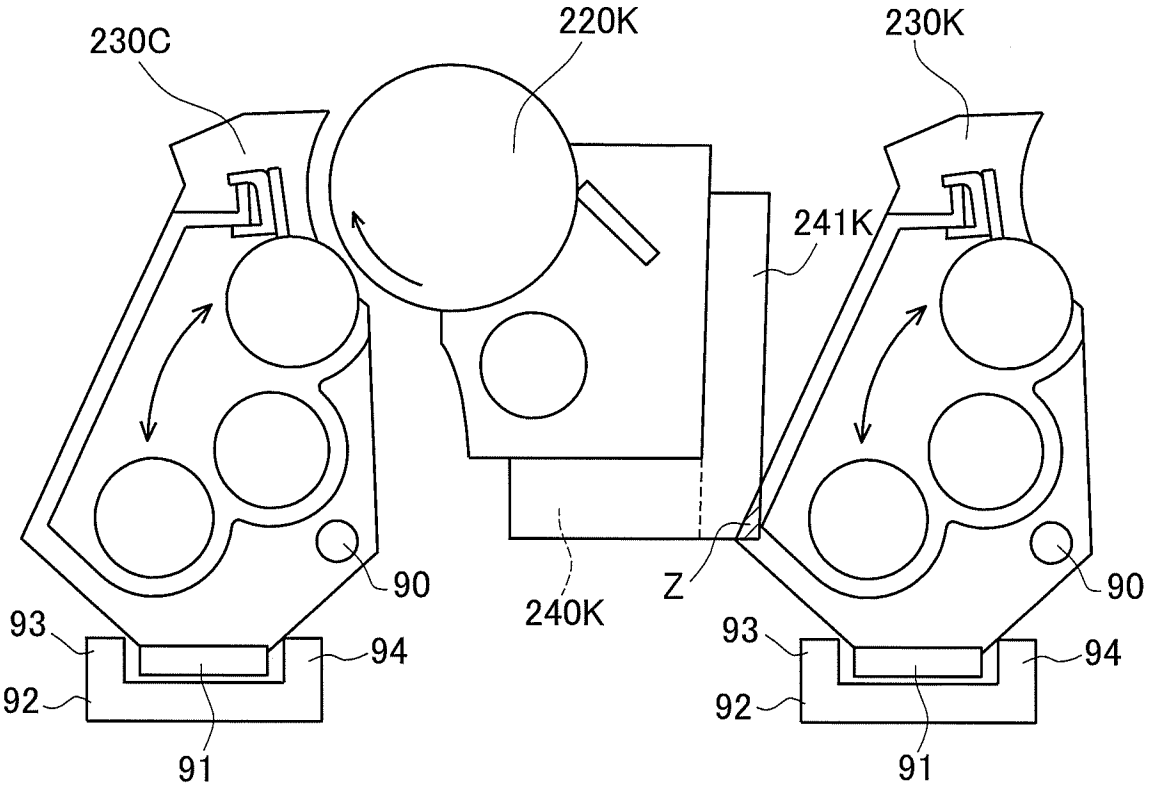
FIG. 12 is an explanatory view for explaining an interference state of the drum unit provided with the interference part.

FIG. 12 shows a case that the drum unit 220K for black is wrongly mounted in the image forming section 10C for cyan. As indicated with Z in FIG. 12, the drum unit 220K for black interferes with the developing unit 230K for black when the drum unit 220K is wrongly mounted in the image forming section 10C for cyan. To be more specific, the stopper 241K on a side surface of the drum unit 220K for black constitutes an interference part which is to interfere with the developing unit 230K for black. Thus, the drum unit 220K for black is not allowed to be mounted in the image forming section 10C for cyan. However, there is a case that the drum unit 220K for black is wrongly mounted in the image forming section 10C for cyan due to breakage of the stopper 241K and others. Even also in such a case, the present invention can achieve notifying a user of the wrong attachment.

Second Embodiment

A second embodiment is now explained. In the second embodiment, pressure receiving part pairs provided in a photoconductor and in a developing roller are different from those in the first embodiment. Specifically, a pressure receiving part pair, which is different from the pair in the first embodiment, is provided in a second outer region of the photoconductor and the developing roller. Other configurations are similar to the image forming apparatus 1 of the first embodiment.

In the present embodiment, similarly to the first embodiment, only the drum unit 20K for black is configured differently from the drum units 20Y, 20M, and 20C for yellow, magenta, and cyan. Therefore, the photoconductors 21 and the developing rollers 31 in the image forming section 10K for black and in the image forming section 10Y for yellow of the present embodiment will be explained in detail in the following explanation.

Figure 13:
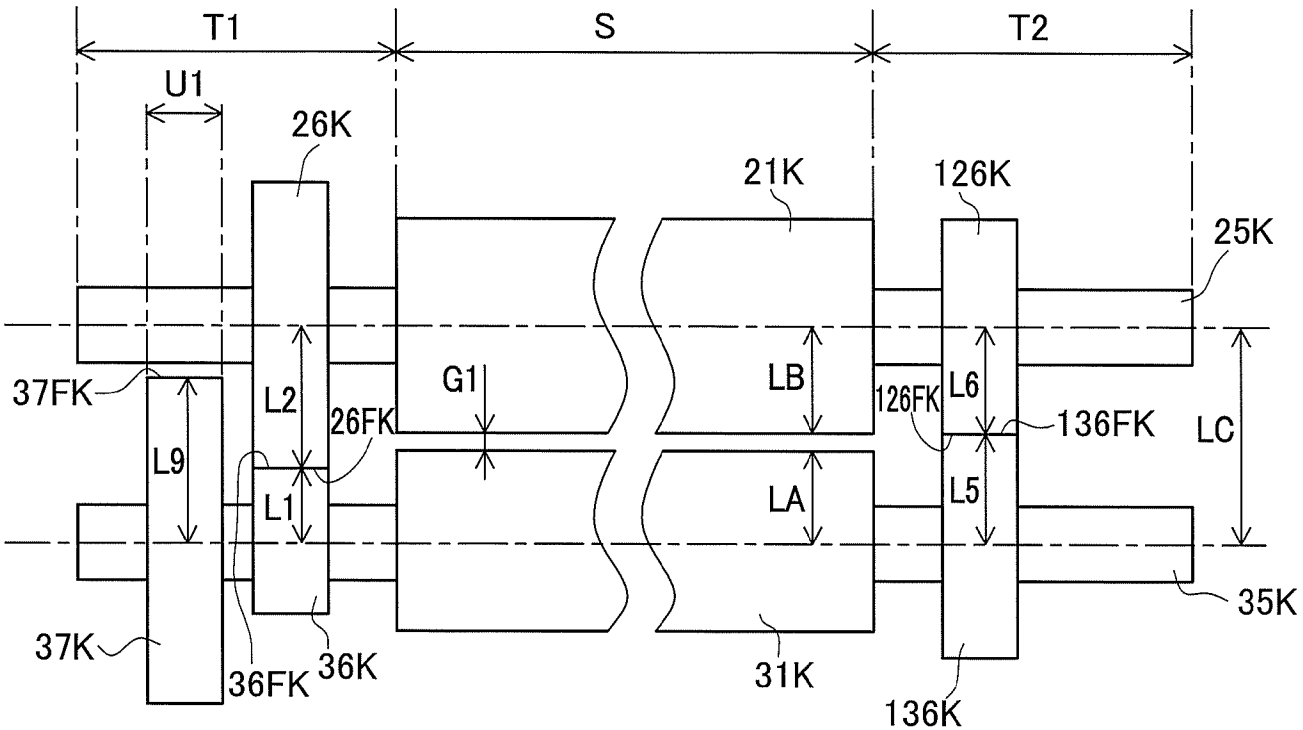
FIG. 13 is a diagram showing a press-contact state of a photoconductor and a developing roller of an image forming section for black in a second embodiment.
Figure 14:
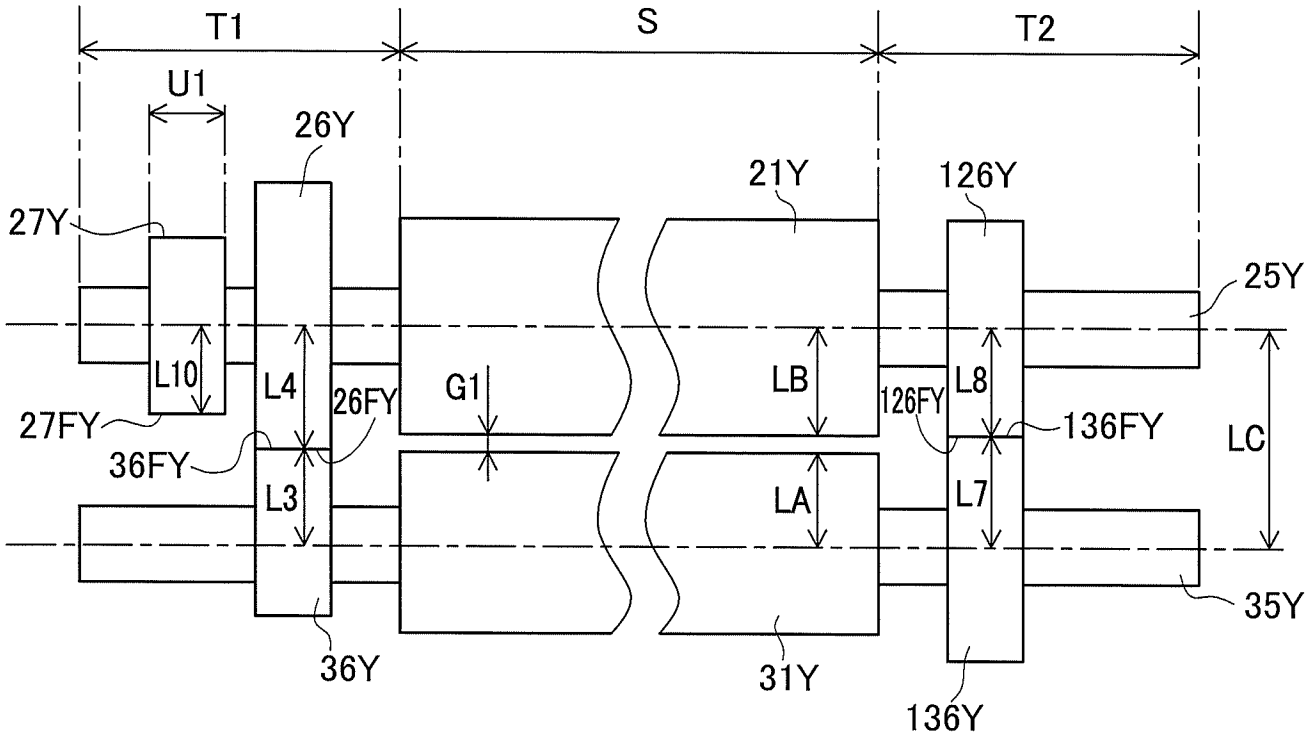
FIG. 14 is a diagram showing a press-contact state of a photoconductor and a developing roller of an image forming section for yellow in the second embodiment.

FIG. 13 shows the photoconductor 21 and the developing roller 31 in the image forming section 10K of the present embodiment. FIG. 14 shows the photoconductor 21 and the developing roller 31 in the image forming section 10Y of the present embodiment. FIG. 13 shows a normal state in which the drum unit 20K for black is appropriately mounted in the image forming section 10K for black. Similarly, FIG. 14 shows a normal state in which the drum unit 20Y for yellow is appropriately mounted in the image forming section 10Y for yellow.

Further, both FIGS. 13 and 14 show that each developing unit 30 in the figures is in a press-contact position. Namely, each figure shows a press-contact state in which the developing roller 31 is pressed against the photoconductor 21. In FIG. 13, each element constituting the image forming section 10K is assigned with a reference sign appended with a suffix "K." In FIG. 14, each element constituting the image forming section 10Y is assigned with a reference sign appended with a suffix "Y".

As shown in FIG. 13, the center region S and the first outer region T1 of the present embodiment are similar to those in the first embodiment shown in FIG. 4. In other words, the photoconductor 21K and the developing roller 31K are provided respectively in an axial center part of the photoconductor shaft 25K and the developing shaft 35K such that the photoconductor 21K and the developing roller 31K face each other in the center region S which corresponds to a toner image forming region.

Further, in the first outer region T1 of the developing shaft 35K, the first pressure receiving part 36K is provided, and in the first outer region T1 of the photoconductor shaft 25K, the second pressure receiving part 26K is provided. Furthermore, as similar to the first embodiment, the first protection part 37K is provided in the first protection region U1 which is located in the first outer region T1 of the developing shaft 35K. In the normal state shown in FIG. 13, the outer circumferential surface 37FK of the first protection part 37K is not in contact with any elements.

On the other hand, in the second outer region T2 of the developing shaft 35K, a fifth pressure receiving part 136K is provided, and in the second outer region T2 of the photoconductor shaft 25K, a sixth pressure receiving part 126K is provided. The fifth pressure receiving part 136K has a fifth pressure receiving surface 136FK contacted with the sixth pressure receiving part 126K in the press-contact state in FIG. 13. Further, the sixth pressure receiving part 126K has a sixth pressure receiving surface 126FK contacted with the fifth pressure receiving part 136K. In other words, the fifth pressure receiving part 136K and the sixth pressure receiving part 126K constitute a pressure receiving part pair, both of which are in contact with each other in the press-contact state.

Therefore, the image forming section of the present embodiment includes the pressure receiving part pair constituted of the fifth pressure receiving part 136K and the sixth pressure receiving part 126K in the second outer region, the pair being different from the pressure receiving part pair constituted of the first pressure receiving part 36K and the second pressure receiving part 26K in the first outer region T1. Unlike the first embodiment, the first protection part 37K is not provided in the second outer region T2 in the present embodiment.

Further, FIG. 13 shows a protruding distance L5 of the fifth pressure receiving part 136K extending from a central axis of the developing roller 31K (the developing shaft 35K) to the fifth pressure receiving surface 136FK and a protruding distance L6 of the sixth pressure receiving part 126K extending from a central axis of the photoconductor 21K (the photoconductor shaft 25K) to the sixth pressure receiving surface 126FK. Further, as shown in FIG. 13, the sum of the protruding distance L5 and the protruding distance L6 is defined as the inter-axis distance LC. In short, the sum of the protruding distance L5 of the fifth pressure receiving part 136K and the protruding distance L6 of the sixth pressure receiving part 126K is equal to the sum of the protruding distance L1 of the first pressure receiving part 36K and the protruding distance L2 of the second pressure receiving part 26K.

However, the protruding distance L5 of the fifth pressure receiving part 136K is made different from the protruding distance L1 of the first pressure receiving part 36K. Further, the protruding distance L6 of the sixth pressure receiving part 126K is made different from the protruding distance L2 of the second pressure receiving part 26K. To be more specific, in the present embodiment, the protruding distance L5 of the fifth pressure receiving part 136K is set larger than the protruding distance L1 of the first pressure receiving part 36K. The protruding distance L6 of the sixth pressure receiving part 126K is set smaller than the protruding distance L2 of the second pressure receiving part 26K.

Further, in the fifth pressure receiving part 136K and the sixth pressure receiving part 126K, a cross section on a plane perpendicular to an axial direction of the developing shaft 35K is similar to that of the first pressure receiving part 36K and the second pressure receiving part 26K as shown in FIG. 6. In the present embodiment, the fifth pressure receiving part 136K is a radial bearing and the sixth pressure receiving part 126K is made of resin. Furthermore, the sixth pressure receiving part 126K is held on the photoconductor shaft 25K, and thereby the sixth pressure receiving part 126K is not rotated with the sixth pressure receiving surface 126FK facing the developing shaft 35K even when the photoconductor 21K is rotated. Accordingly, the fifth pressure receiving part 136K and the sixth pressure receiving part 126K are not to interfere with rotation of the photoconductor 21K and the developing roller 31K. Moreover, the inter-axis distance LC and the clearance G1 are remained unchanged.

Next, a configuration of the image forming section 10Y is explained with reference to FIG. 14. As shown in FIG. 14, in the present embodiment, the center region S and the first outer region T1 are similar to those in the first embodiment shown in FIG. 5. In other words, the photoconductor 21Y and the developing roller 31Y are provided respectively in an axial center part of the photoconductor shaft 25Y and the developing shaft 35Y such that the photoconductor 21Y and the developing roller 31Y face each other in the center region S which corresponds a toner image forming region.

Further, in the first outer region T1 of the developing shaft 35Y, the third pressure receiving part 36Y is provided, and in the first outer region T1 of the photoconductor shaft 25Y, the fourth pressure receiving part 26Y is provided. Furthermore, as similar to the first embodiment, the second protection part 27Y is provided in the first protection region U1 which is located in the first outer region T1 of the photoconductor shaft 25Y. In the normal state shown in FIG. 14, the outer circumferential surface 27FY of the second protection part 27Y is not in contact with any elements.

On the other hand, in the second outer region T2 of the developing shaft 35Y, a seventh pressure receiving part 136Y is provided, and in the second outer region T2 of the photoconductor shaft 25Y, an eighth pressure receiving part 126Y is provided. The seventh pressure receiving part 136Y has a seventh pressure receiving surface 136FY contacted with the eighth pressure receiving part 126Y in the press-contact state shown in FIG. 14. Further, the eighth pressure receiving part 126Y has an eighth pressure receiving surface 126FY contacted with the seventh pressure receiving part 136Y. In other words, the seventh pressure receiving part 136Y and the eighth pressure receiving part 126Y constitute a pressure receiving part pair both of which are in contact with each other in the press-contact state.

Therefore, the image forming section of the present embodiment includes the pressure receiving part pair constituted of the seventh pressure receiving part 136Y and the eighth pressure receiving part 126Y in the second outer region T2, the pair being different from the pressure receiving part pair constituted of the third pressure receiving part 36Y and the fourth pressure receiving part 26Y in the first outer region T1. Unlike the first embodiment, the second protection part 27Y is not provided in the second outer region T2 in the present embodiment.

Further, FIG. 14 shows a protruding distance L7 of the seventh pressure receiving part 136Y extending from a central axis of the developing roller 31Y (the developing shaft 35Y) to the seventh pressure receiving surface 136FY and a protruding distance L8 of the eighth pressure receiving part 126Y extending from a central axis of the photoconductor 21Y (the photoconductor shaft 25Y) to the eighth pressure receiving surface 126FY. As shown in FIG. 14, the sum of the protruding distance L7 and the protruding distance L8 is defined as the inter-axis distance LC. In short, the sum of the protruding distance L7 of the seventh pressure receiving part 136Y and the protruding distance L8 of the eighth pressure receiving part 126Y is equal to the sum of the protruding distance L3 of the third pressure receiving part 36Y and the protruding distance L4 of the fourth pressure receiving part 26Y.

However, the protruding distance L7 of the seventh pressure receiving part 136Y is made different from the protruding distance L3 of the third pressure receiving part 36Y. Further, the protruding distance L8 of the eighth pressure receiving part 126Y is made different from the protruding distance L4 of the fourth pressure receiving part 26Y. To be more specific, in the present embodiment, the protruding distance L7 of the seventh pressure receiving part 136Y is set larger than the protruding distance L3 of the third pressure receiving part 36Y. Further, the protruding distance L8 of the eighth pressure receiving part 126Y is set smaller than the protruding distance L4 of the fourth pressure receiving part 26Y.

Further, in the seventh pressure receiving part 136Y and the eighth pressure receiving part 126Y, similarly to the above, a cross section of a plane perpendicular to an axial direction of the developing shaft 35Y is similar to that of the first pressure receiving part 36K and the second pressure receiving part 26K in FIG. 6. In the present embodiment, the seventh pressure receiving part 136Y is a radial bearing and the eighth pressure receiving part 126Y is made of resin. Furthermore, the eighth pressure receiving part 126Y is held on the photoconductor shaft 25Y, and thereby the eighth pressure receiving part 126Y is not rotated with the eighth pressure receiving surface 126FY facing the developing shaft 35Y even when the photoconductor 21Y is rotated. Accordingly, the seventh pressure receiving part 136Y and the eighth pressure receiving part 126Y are not to interfere with rotation of the photoconductor 21Y and the developing roller 31Y. Moreover, the inter-axis distance LC and the clearance G1 are remained unchanged.

The pressure receiving part pair of the present embodiment is further configured such that the sum of the protruding distance L1 of the first pressure receiving part 36K and the protruding distance L4 of the fourth pressure receiving part 26Y is made different from the sum of the protruding distance L5 of the fifth pressure receiving part 136K and the protruding distance L8 of the eighth pressure receiving part 126Y. Thus, the sum of the protruding distance L2 of the second pressure receiving part 26K and the protruding distance L3 of the third pressure receiving part 36Y is also made different from the sum of the protruding distance L6 of the sixth pressure receiving part 126K and the protruding distance L7 of the seventh pressure receiving part 136Y.

In the present embodiment, the sum of the protruding distance L1 of the first pressure receiving part 36K and the protruding distance L4 of the fourth pressure receiving part 26Y is set smaller than the sum of the protruding distance L5 of the fifth pressure receiving part 136K and the protruding distance L8 of the eighth pressure receiving part 126Y. Further, the sum of the protruding distance L2 of the second pressure receiving part 26K and the protruding distance L3 of the third pressure receiving part 36Y is set larger than the sum of the protruding distance L6 of the sixth pressure receiving part 126K and the protruding distance L7 of the seventh pressure receiving part 136Y. Those dimensional relations of the pressure receiving part pairs enable the image forming apparatus 1 of the present embodiment to appropriately make the user aware of wrong attachment of the drum unit 20.

Herein, in the present embodiment, the protruding distance L5 and the protruding distance L7 are designed to be equal. Moreover, the protruding distance L6 and the protruding distance L8 are designed to be equal.

In the present embodiment, the sum of the radius L9 of the first protection part 37K and the radius L10 of the second protection part 27Y are set to be larger at least than the sum of the radius LA of the developing roller 31K and the radius LB of the photoconductor 21Y. Moreover, also in the present embodiment, the sum of the radius L9 of the first protection part 37K and the radius L10 of the second protection part 27Y are set to be larger than the inter-axis distance LC. As a result, these configurations achieve prevention of breakage of the image forming section 10 when the drum unit 20 is wrongly mounted.

Figure 15:
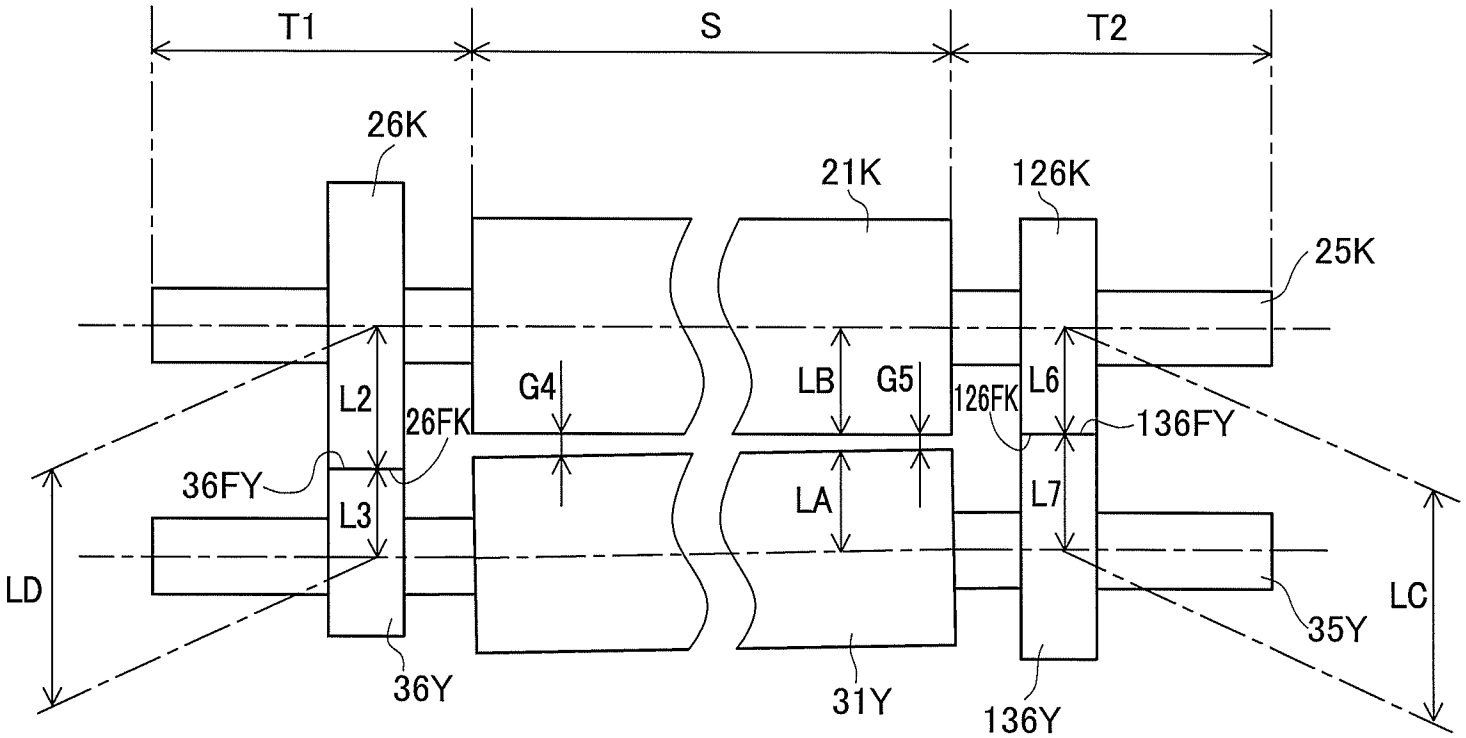
FIG. 15 is a diagram showing a press-contact state of the photoconductor and the developing roller when a drum unit for black is erroneously mounted in the image forming section for yellow in the second embodiment.

Next, examples in which the drum units 20Y and 20K are wrongly mounted are explained in detail with reference to FIGS. 15 and 16. FIG. 15 shows the photoconductor 21K and the developing roller 31Y when the drum unit 20K for black is wrongly mounted in the image forming section 10Y for yellow. FIG. 15 shows the press-contact state of the photoconductor 21K and the developing roller 31Y.

In the present embodiment, the third pressure receiving part 36Y and the second pressure receiving part 26K are contacted in the first outer region T in the press-contact state as shown in FIG. 15. Therefore, when the drum unit 20K is wrongly mounted in the image forming section 10Y as shown in FIG. 15, an inter-axis distance LD between the third pressure receiving part 36Y and the second pressure receiving part 26K is larger than the inter-axis distance LC of the normal state.

On the other hand, in the second outer region T2 in the press-contact state, the seventh pressure receiving part 136Y and the sixth pressure receiving part 126K are contacted as shown in FIG. 15. Based on the above-mentioned dimensional relation of pressure receiving parts, the protruding distance L5 and the protruding distance L7 are equal, and the protruding distance L6 and the protruding distance L8 are equal in the present embodiment. Accordingly, when the drum unit 20K is wrongly mounted in the image forming section 10Y as shown in FIG. 15, the inter-axis distance of the seventh pressure receiving part 136Y and the sixth pressure receiving part 126K is equal to the inter-axis distance LC of the normal state.

Therefore, central axes of the photoconductor 21K and the developing roller 31Y in the center region S are not parallel but inclined to each other. Specifically, the photoconductor 21K and the developing roller 31Y are inclined to be apart from each other as coming close to a left side in FIG. 15. Thus, as shown in FIG. 15, as for a clearance between the photoconductor 21K and the developing roller 31Y, a clearance G4 in a left end part of the center region S is larger than a clearance G5 in a right end part.

As mentioned above, in general, the larger the clearance between the photoconductor 21 and the developing roller 31 becomes, the lower the toner density of the formed toner image is likely to be since the toner amount moving from the developing roller 31 to the photoconductor 21 decreases.

Accordingly, in FIG. 15 showing that the drum unit 20K is wrongly mounted in the image forming section 10Y, the clearance G4 is larger than the clearance G5, and thus the density of the formed toner image becomes lower as coming close to the left side. In other words, in the present embodiment, when a yellow-colored toner image is formed by the image forming section 10Y in which the drum unit 20K is wrongly mounted, an image fixed on the sheet P with that toner image is low in yellow density lower on one end side than on the other end side in a width direction of the sheet P. When the user becomes aware of the output image in which the yellow density differs in the width direction of the sheet P, he can notice that the wrong drum unit 20K is mounted in the image forming section 10Y.

Figure 16:
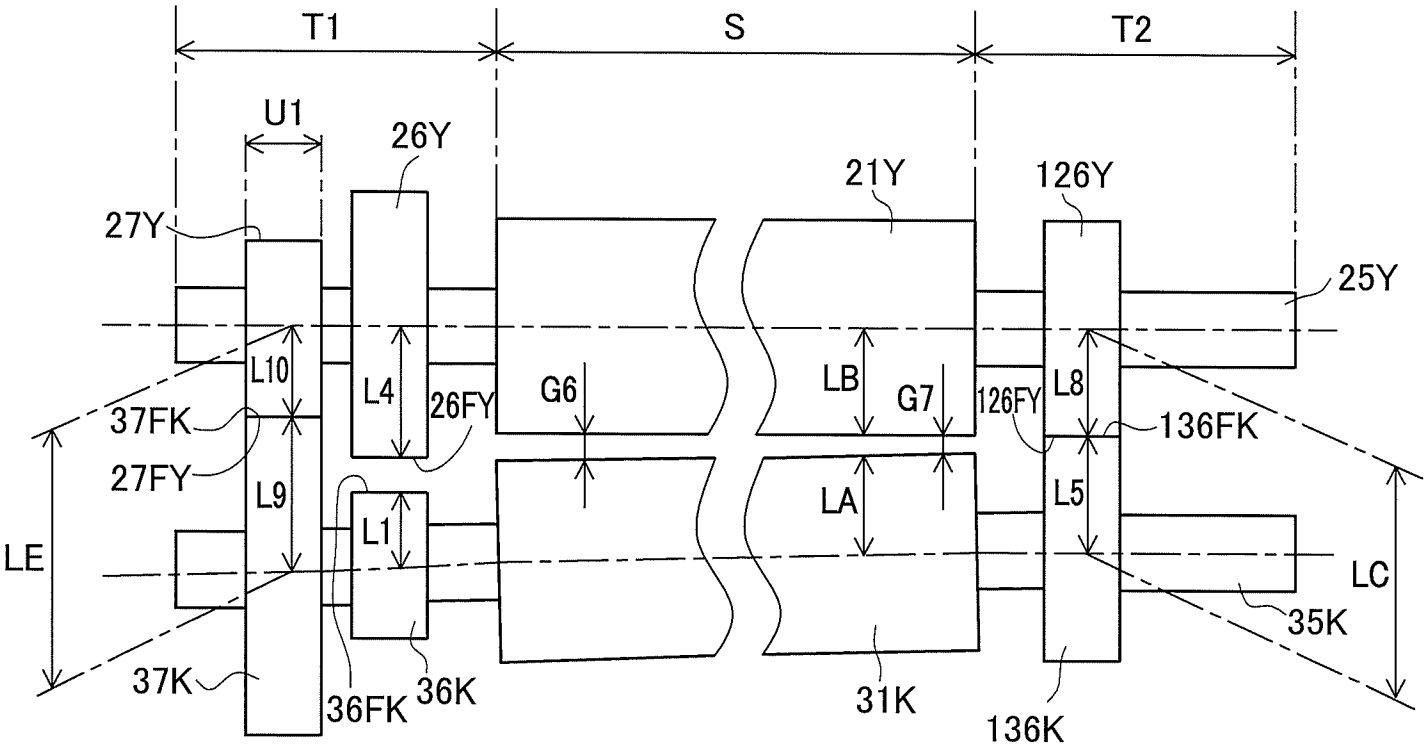
FIG. 16 is a diagram showing a press-contact state of the photoconductor and the developing roller when a drum unit for yellow is erroneously mounted in the image forming section for black in the second embodiment.

FIG. 16 shows the photoconductor 21Y and the developing roller 31K when the drum unit 20Y is mounted in the image forming section 10K. FIG. 16 also shows the press-contact state of the photoconductor 21Y and the developing roller 31K. In the present embodiment, as shown in FIG. 16, the first pressure receiving part 36K and the fourth pressure receiving part 26Y each having the small protruding distance L1 and L4 are not contacted in the first outer region T1 in the press-contact state.

On the contrary, in the first protection region U1 of the first outer region T1, the first protection part 37K and the second protection part 27Y having the large radii L9 and L10 are contacted. Those protection parts are provided to prevent interference of the photoconductor 21Y and the developing roller 31K. Therefore, when the drum unit 20Y is wrongly mounted in the image forming section 10K shown in FIG. 16, an inter-axis distance LE between the first protection part 37K and the second protection part 27Y is larger than the inter-axis distance LC of the normal state.

In the second outer region T2 in the press-contact state, as shown in FIG. 16, the fifth pressure receiving part 136K and the eighth pressure receiving part 126Y are contacted. Herein, based on the dimensional relation of the pressure receiving parts mentioned above, the protruding distance L5 and the protruding distance L7 are equal and the protruding distance L6 and the protruding distance L8 are equal in the present embodiment. Therefore, when the drum unit 20Y is wrongly mounted in the image forming section 10K shown in FIG. 16, the inter-axis distance is equal to the inter-axis distance LC of the normal state in the fifth pressure receiving part 136K and the eighth pressure receiving part 126Y.

Accordingly, axes of the photoconductor 21Y and the developing roller 31K in the center region S are not parallel but inclined to each other. To be specific, the photoconductor 21Y and the developing roller 31K are inclined to be apart from each other as coming close to a left side in FIG. 16. Thus, as shown in FIG. 16, as for a clearance between the photoconductor 21Y and the developing roller 31K, a clearance G6 in a left end part of the center region S is larger than a clearance G7 in a right end part.

Consequently, in FIG. 16 showing that the drum unit 20Y is wrongly mounted in the image forming section 10K, the clearance G6 is larger than the clearance G7 and thus density of the formed toner image becomes lower as coming closer to the left side. Namely, in the present embodiment, when a black-colored toner image is formed by the image forming section 10K in which the drum unit 20Y is wrongly mounted, an image fixed on the sheet P with that toner image is low in black density lower on one end side than on the other end side in a width direction of the sheet P. When the user becomes aware of the output image in which the black density differs in the width direction of the sheet P, he can notice that the wrong drum unit 20Y is mounted in the image forming section 10K.

Also in the present embodiment, the sum of the radius L9 of the first protection part 37K and the radius L10 of the second protection part 27Y may be equal to the inter-axis distance LC. In such a case, the user cannot notice that the drum unit 20Y is wrongly mounted in the image forming section 10K. However, as explained with FIG. 15, the user can be made aware of the wrong attachment of the drum unit 20K in the image forming section 10Y.

Further, the first protection part 37K and the second protection part 27Y are not necessarily essential in the present embodiment as similar to the first embodiment. The protection parts are unnecessary as long as the first pressure receiving part 36K and the fourth pressure receiving part 26Y are contacted but the developing roller 31K and the photoconductor 21Y are out of contact. In that case, the photoconductor 21Y and the developing roller 31K are inclined in an orientation opposite from the orientation in the embodiment. In short, the photoconductor 21Y and the developing roller 31K are inclined to be apart from each other as close to a right side in FIG. 16.

As mentioned above, when the drum units 20Y and 20K are each mounted wrongly in the image forming sections 10Y and 10K, the image forming apparatus 1 of the present embodiment is configured such that the sheet P is output with the color of wrong attachment lighter or paler on one end side than on the other end side in the width direction of the sheet P. Thereby, the user can be made aware of the wrong attachment. Further, in the present embodiment, the user can be more easily notified of the wrong attachment than in the first embodiment. This is because the density of color differs in the width direction of the output sheet P. The user notified of the wrong attachment can then replace the drum units 20Y and 20K which are wrongly mounted with appropriate ones. Accordingly, the wrong attachment of each of the drum units 20Y and 20K in the image forming sections 10Y and 10K can be restrained.

Further, in the present embodiment, even when the drum units 20Y and 20K are wrongly mounted, components of the image forming apparatus 1 do not suffer from breakage. This is because the first pressure receiving part 36K and others are designed to have enough strength to receive a press-contact force in the normal press-contact state. The first protection part 37K and the second protection part 27Y can also be designed in advance to have enough strength to endure the press-contact force in the press-contact state.

In the above configuration, when the drum units 20Y and 20K are wrongly mounted in the image forming sections 10Y and 10K, that wrong attachment can be informed to the user by the density of the image formed on the sheet P. As one alternative for this, a display part is provided in the image forming apparatus 1 and the display part may indicate the wrong attachment to the user. In that case, the density sensors 40 and 41 can be used for detection of the wrong attachment in the image forming apparatus 1 of the present embodiment. Therefore, in the present embodiment, a test control similar to the test control explained in the first embodiment can be performed.

As another alternative, in the present embodiment, a test control different from the test control of the first embodiment may be performed. The test control may be performed such that the wrong attachment is detected by detecting the difference of the toner density of a toner image which has different toner density in the width direction.

In the test control by the density difference of the toner image, for example, the image forming sections 10Y and 10k are firstly operated to form a test pattern of a predetermined toner image in the present embodiment. In the test control by the density difference of the toner image, as the test pattern, toner images are arranged to be formed at positions passing through the detection points of the density sensors 40 and 41 which are disposed apart from each other with an interval in the width direction. Further, the test pattern is arranged in advance to be developed with the same density at positions passing through the detection points of the density sensors 40 and 41. The formed test pattern is detected by each of the density sensors 40 and 41.

When the difference of the toner density output by each of the density sensors 40 and 41 is out of a predetermined allowable range of a toner density difference, it is determined that the wrong attachment occurs. Further, when it is determined that the wrong attachment occurs, the display part provided in the image forming apparatus 1 may display the fact of wrong attachment. In this case, the CPU 4 may be provided with a test control part for performing the above mentioned test control by the density difference of the toner image and a toner density difference output part to obtain and output the difference of the toner density output by the density sensors 40 and 41. Furthermore, the nonvolatile memory 5 may be recorded with the predetermined test pattern and the allowable range of the toner density difference.

Further, when it is determined by the test control that the wrong attachment occurs, a normal image forming operation by the image forming section 10 mounted with the wrong drum unit may be disallowed. As another alternative, when it is determined by the test control that the wrong attachment occurs, not only image forming by the image forming section 10 mounted with the wrong drum unit, but all the normal image forming operations may be disallowed.

Further, also in the present embodiment, the drum units 20Y, 20M, and 20C for yellow, magenta, and cyan other than black have the same configuration. Accordingly, the drum units 20M and 20C for magenta and cyan may be configured as similar to the drum unit 20Y for yellow. The developing rollers 31 for magenta and cyan may also be provided with elements similar to the pressure receiving parts of the developing roller 31Y for yellow.

Therefore, in the image forming apparatus 1, the user can be notified that any one of the drum units 20Y, 20M, and 20C for yellow, magenta, and cyan is wrongly mounted in the image forming section 10K for black. Further, the user can also be notified that the drum unit 20K for black is wrongly mounted in any one of the image forming sections 10Y, 10M, and 10C for yellow, magenta, and cyan.

Even when the drum units 20 for yellow, magenta, cyan, and black have different configurations, as long as their dimensional relations are similar to the above mentioned relation between the yellow drum unit and the black drum unit, the user can be notified of the wrong attachment in the present embodiment, too. To be specific, each of the photoconductors 21 and the developing rollers 31 for each color may be provided with a pressure receiving part pair configured to make a clearance between the photoconductor 21 and the developing roller 31 different from the clearance G1 when the image forming section 10 is mounted with the wrong drum unit 20. Further, when any one of the pressure receiving part pairs in wrong attachment has the sum of the protruding distances smaller than the sum of the radius LA and the radius LB, at least shafts of the pressure receiving parts may be provided with an element similar to the first protection part 37K and the second protection part 27Y. When the pressure receiving part pair in wrong attachment has the sum of the protruding distances smaller than the inter-axis distance LC, it is preferable to provide elements similar to the first protection part 37K and the second protection part 27Y. As a result, the contact between the photoconductor 21 and the developing roller 31 can be surely prevented.

As mentioned above, the black-colored toner image tends to be formed frequently as compared with toner images with other colors. Therefore, among the drum units 20 for each color, the drum unit 20K for black has high frequency in replacement and thus is apt to have large distribution amount on the market. Accordingly, the possibility of wrongly mounting the drum unit 20K for black by the user is higher than the possibility of wrongly mounting the drum units 20Y, 20M, and 20C for other colors.

Therefore, when the drum units 20 for yellow, magenta, cyan, and black have configurations different from one another, it is preferable to make at least the pressure receiving part pair for black different from the pressure receiving part pairs for other colors. In short, it is preferable that the user is made aware of the wrong attachment of the drum unit 20K to any one of the image forming sections 10Y, 10M, and 10C and that the wrong attachment of the drum unit 20K is prevented.

Further, in the present embodiment, it is preferable that one of the pressure receiving part pair provided in the photoconductor 21 or the developing roller 31 is adjustable with its protruding distance. This is because the clearance G1 between the photoconductor 21 and the developing roller 31 in the normal state can be adjusted in a manufacturing process of the drum unit 20 or the developing unit 30. Accordingly, in the present embodiment, it is conceivable that the second pressure receiving part 26K and the sixth pressure receiving part 126K of the drum unit 20 for black are, for example, configured to be movable to come close to or apart from the developing roller 31K before fixation of the drum unit.

As explained in detail above, also in the present embodiment, the photoconductor 21 and the developing roller 31 are provided with pressure receiving part pairs, each pair being contacted with each other in the press-contact state. In the present embodiment, the pressure receiving part pair differs in the first outer region T1 and in the second outer region T2. Specifically, in the image forming section 10 in which the wrong attachment of the drum unit 20 occurs, the clearance between the photoconductor 21 and the developing roller 31 is increased from one end side to the other end side in an axial direction. Thus, an image forming apparatus can achieve prevention of breakage caused by the wrong attachment in a replacement part and prevention of the wrong attachment, and a drum unit used for that displacement part of the image forming apparatus can be realized.

The present invention is exemplified with the above embodiment, but it is not limited to the above embodiment and may be naturally applied with various changes and modifications without departing from the scope of its subject matter. For example, the above embodiment is explained with an example that the drum unit 20 is configured to be replaceable. Alternatively, the present invention is naturally applicable to the configuration that the developing unit 30 is replaceable. In this case, an image forming apparatus can achieve prevention of breakage caused by wrong attachment in the replacement part and prevention of the wrong attachment, and a developing unit used as the replacement part of the image forming apparatus is realized.

As another alternative, both the drum unit 20 and the developing unit 30 may be replaceable parts. Further, the dimensional relation of the protruding distances of the pressure receiving part pair is not limited to the above embodiment. Namely, the pressure receiving part pair in the above embodiment may be switched between the photoconductor 21 and the developing unit 31. Further, for example, the drum unit 20 as a replacement part includes the charger 22 and others as well as the photoconductor 21 in the above embodiment. Alternatively, as the replacement part, the configuration may include at least the photoconductor 21 and the pressure receiving part on a side close to the photoconductor 21. Furthermore, the present invention is not limited to a color printer and is applicable to, for example, an image forming apparatus conducting transmission and reception of printing jobs through public lines.

Further, for example, other techniques of preventing wrong attachment may be applied in addition to the above embodiment. For example, a substrate recorded with color information is provided in the drum unit 20 and a reading part to read out the substrate's color information is provided in the image forming sections 10 for each color.

Further alternatively, the drum unit 20 may be configured not to be mounted in the image forming section 10 for different color. As such a configuration, one example is shown in FIGS. 9 to 12.

An image forming apparatus according to the above embodiment comprises a plurality of image forming sections for each color, each including an image carrier configured to rotate and carry a toner image during image forming and a developing part provided with a developing roller and configured to contain and apply toner to the image carrier by rotating the developing roller to form a toner image on the image carrier; and a press section configured to press at least one of the image carrier and the developing roller to the other to bring them in a press-contact state during image forming, wherein one of the developing roller and the image carrier is a first rotary body and the other is a second rotary body, and the first rotary body and the second rotary body define a toner image forming region in which the toner is applied from the developing roller to the image carrier, each of the image forming sections for each color includes a pair of pressure receiving parts provided in a first outer region located axially outside the toner image forming region, the image forming sections for each color include a first image forming section and a second image forming section, the first image forming section is configured to form a toner image of a first color and includes: a first pressure receiving part provided to the first rotary body as one of the pair of pressure receiving parts and formed with a first pressure receiving surface contacted with the other one of the pair of pressure receiving parts in the press-contact state; and a second pressure receiving part provided to the second rotary body as the other one of the pair of pressure receiving parts and formed with a second pressure receiving surface contacted with the first pressure receiving surface in the press-contact state, the second image forming section is configured to form a toner image of a second color that is different from the first color, includes: a third pressure receiving part provided to the first rotary body as one of the pair of pressure receiving parts and formed with a third pressure receiving surface contacted with the other one of the pair of pressure receiving part in the press-contact state; and a fourth pressure receiving part provided to the second rotary body as the other one of the pair of pressure receiving parts and formed with a fourth pressure receiving surface contacted with the third pressure receiving surface in the press-contact state, and the image forming apparatus is configured to satisfy both relationships expressed by: $L1<L3$, and $L2>L4$ in which L1 denotes a protruding distance of the first pressure receiving part extending from a central axis of the first rotary body to the first pressure receiving surface, L2 denotes a protruding distance of the second pressure receiving part extending from a central axis of the second rotary body to the second pressure receiving surface, L3 denotes a protruding distance of the third pressure receiving part extending from the central axis of the first rotary body to the third pressure receiving surface, and L4 denotes a protruding distance of the fourth pressure receiving part extending from the central axis of the second rotary body to the fourth pressure receiving surface.

The above image forming apparatus includes the first image forming section and the second image forming section, both providing the pressure receiving part pair in the first outer region of the first rotary body and the second rotary body, in which each pressure receiving part has different protruding distances. Therefore, when one of the first image forming section and the second image forming section is mounted with the first or second rotary body of the other image forming section, the toner image formed in the image forming section with wrong attachment has a density different from the density of normal state in which the rotary body is appropriately mounted. Thereby, a user can be notified that the first or second rotary body is wrongly mounted by the toner image formed with the density different from the normal state. Accordingly, the thus wrongly mounted first or second rotary body can be replaced with an appropriate one. Further, the first pressure receiving part and others are designed to receive a load in a press-contact state even in the normal state in which the first or second rotary body is appropriately mounted. Therefore, even when the first or second rotary body is wrongly mounted, components of the image forming section are prevented from breakage. As a result, any breakage can be prevented even when the wrong attachment occurs in the replacement part, and thus the wrong attachment is restrained.

Further, in the above mentioned image forming apparatus, preferably each of the first and second image forming sections further includes a pair of pressure receiving parts contacted each other in the press-contact state in a second outer region located opposite to the first outer region interposed with the toner image forming region in the first and second rotary bodies, the first image forming section includes as the pair of pressure receiving parts in the second outer region, a fifth pressure receiving part provided to the first rotary body as one of the pair of pressure receiving parts in the second outer region and formed with a fifth pressure receiving surface contacted with the other one of the pair of pressure receiving parts in the second outer region in the press-contact state; and a sixth pressure receiving part provided to the second rotary body as the other one of the pressure receiving parts in the second outer region and formed with a sixth pressure receiving surface contacted with the fifth pressure receiving surface in the press-contact state, the second image forming section includes as the pair of pressure receiving parts in the second outer region, a seventh pressure receiving part provided to the first rotary body as one of the pair of pressure receiving parts in the second outer region and formed with a seventh pressure receiving surface contacted with the other one of the pressure receiving parts in the second outer region in the press-contact state; and an eighth pressure receiving part provided to the second rotary body as the other one of the pair of pressure receiving parts in the second outer region and formed with an eighth pressure receiving surface contacted with the seventh pressure receiving surface in the press-contact state, and the image forming apparatus is configured to satisfy relationships expressed by: $L1\neq L5$; $L2\neq L6$; $L1+L2=L5+L6$; $L3+L4=L7+L8$; and $L1+L4\neq L5+L8$ in which L5 denotes a protruding distance of the fifth pressure receiving part extending from the central axis of the first rotary body to the fifth pressure receiving surface, L6 denotes a protruding distance of the sixth pressure receiving part extending from the central axis of the second rotary body to the sixth pressure receiving surface, L7 denotes a protruding distance of the seventh pressure receiving part extending from the central axis of the first rotary body to the seventh pressure receiving surface, and L8 denotes a protruding distance of the eighth pressure receiving part extending from the central axis of the second rotary body to the eighth pressure receiving surface. When the wrong attachment of the first rotary body of the first image forming section and the second rotary body of the second image forming section occurs, the toner image formed by the image forming section has the density different on one end side and on the other side in an axial direction of the image carrier. Accordingly, a user can be surely notified of the wrong attachment.

Further, in the above mentioned image forming apparatus, preferably the first image forming section includes a first protection region in the first outer region of the first rotary body, the first protection region being located other than in a region provided with the pair of pressure receiving parts, the first protection region includes a first protection part protruding toward the second rotary body from the central axis of the first rotary body, the second image forming section includes a second protection region which is overlapped with the first protection region of the second rotary body, the second protection region including a second protection part protruding toward the first rotary body from the central axis of the second rotary body, and the image forming apparatus is configured to satisfy a relationship expressed by: $L9+L10>LA+LB$ in which L9 denotes a distance of the first protection part extending from the central axis of the first rotary body to a leading end of the first protection part, L10 denotes a distance of the second protection part extending from the central axis of the second rotary body to a leading end of the second protection part, LA denotes a radius of the first rotary body of the first image forming section in the toner image forming section, and LB denotes a radius of the second rotary body of the second image forming section in the toner image forming section. When the wrong attachment of the first rotary body of the first image forming section and the second rotary body of the second image forming section occurs, there is a case that an inter-axis distance of the first rotary body and the second rotary body becomes smaller than the inter-axis distance in the normal state in the first outer region. Even in such a case, the contact between the first rotary body and the second rotary body in the toner image forming region can be prevented and breakage of those components can be prevented.

Further, in the above mentioned image forming apparatus, preferably the image forming apparatus further includes: a display part for displaying information to a user; a density value output part provided downstream of the first and second image forming sections in a toner-image conveying direction to detect and output a density value indicating a toner application amount on the toner image; a test control part to perform a test control of forming a test pattern of a toner image for a predetermined test on at least one of the first and second image forming sections; and an allowable range recording section to record a predetermined allowable range of the density value of the test pattern, and the test control part performs the test control such that the test pattern is formed by at least one of the first and second image forming sections, and when the density value of the formed test pattern output from the density value output part is outside the allowable range, the display part displays that one of the developing roller and the image carrier is wrongly mounted in one of the first and second image forming sections which formed the test pattern. The user can be further surely notified of the wrong attachment of the developing roller or the image carrier.

Further, in the above mentioned image forming apparatus, preferably one of the first and second image forming sections is configured to form a black toner image, and the other one is configured to form a toner image with a color other than black. A black-colored toner image is likely to be formed more frequently than toner images with other colors. Therefore, an image carrier and a developing roller for black may have life expectancy or the like different from those for other colors. When the image carriers and the developing rollers for black and for other colors are wrongly mounted, the image forming apparatus cannot be appropriately controlled, so that there is a high possibility of decline in formed image quality and causing breakage. Further, on the market, image forming components for black has large distribution amount larger than other colors, and the components for black tend to be wrongly mounted in image forming sections for other colors.

Further, in the above mentioned image forming apparatus, preferably the first and second image forming sections each include an adjustment part to adjust the protruding distance of at least one of the pressure receiving parts. Thus, a clearance between the image carrier and the developing roller in the toner image forming region can be finely adjusted.

A drum unit according to the above embodiments comprises an image carrier configured to rotate and to be applied with toner from a developing roller during image forming, the drum unit being mounted in an image forming section of the image forming apparatus according to claim 1 provided with a press part to press at least one of an image carrier and a developing roller to the other one to bring them in a press-contact state, wherein the drum unit further includes a pressure receiving part provided in the image carrier in an axially outer region located outside a toner image forming region which is to be applied with toner from the developing roller and formed with a pressure receiving surface contacted with a part of the developing roller which is overlapped with the outer region in the press-contact state, and the pressure receiving part has a protruding distance from a central axis of the image carrier to the pressure receiving surface, the distance being different from a distance of the similar type of drum unit including an image carrier to be applied with toner of a different color from a developing roller. Thus, the drum unit can be prevented from breakage when wrong attachment occurs, and the wrong attachment can be prevented.

A developing unit according to the above embodiments comprises a developing roller to rotate and apply toner to an image carrier during image forming and an accommodation part to accommodate the toner to be supplied to the developing roller, the developing unit being mounted in an image forming section of the image forming apparatus according to claim 1 which is provided with a press part to press at least one of the image carrier and the developing roller onto the other one in image forming to bring them in a press-contact state, wherein the developing unit further includes a pressure receiving part which is provided in the developing roller in an axially outer region located outside a toner image forming region to apply a toner onto the image carrier, and the pressure receiving part has a protruding distance from a central axis of the developing roller to the pressure receiving surface, the distance being different from a distance of the similar type of developing unit including a developing roller to apply a toner with a different color to an image carrier. Thus, the developing unit can be prevented from breakage when wrong attachment occurs, and thus the wrong attachment can be prevented.

REFERENCE SIGNS LIST

1 Image forming apparatus
10 Image forming section
20 Drum unit
21 Photoconductor
30 Developing unit
31 Developing roller
26K Second pressure receiving part
26FK Second pressure receiving surface
36K First pressure receiving part
36FK First pressure receiving surface
26Y Fourth pressure receiving part
26FY Fourth pressure receiving surface
36Y Third pressure receiving part
36FY Third pressure receiving surface
92 Press and separation part
L1, L2, L3, L4 Protruding distance

What is claimed is:

1. An image forming apparatus comprising:

a plurality of image forming sections for each color, each including an image carrier configured to rotate and carry a toner image during image forming and a developing part provided with a developing roller and configured to contain and apply toner to the image carrier by rotating the developing roller to form a toner image on the image carrier; and a press section configured to press at least one of the image carrier and the developing roller to the other to bring them in a press-contact state during image forming, wherein one of the developing roller and the image carrier is a first rotary body and the other is a second rotary body, and the first rotary body and the second rotary body define a toner image forming region in which the toner is applied from the developing roller to the image carrier, each of the image forming sections for each color includes a pair of pressure receiving parts provided in a first outer region located axially outside the toner image forming region, the image forming sections for each color include a first image forming section and a second image forming section, the first image forming section is configured to form a toner image of a first color and includes:

a first pressure receiving part provided to the first rotary body as one of the pair of pressure receiving parts and formed with a first pressure receiving surface contacted with the other one of the pair of pressure receiving parts in the press-contact state; and a second pressure receiving part provided to the second rotary body as the other one of the pair of pressure receiving parts and formed with a second pressure receiving surface contacted with the first pressure receiving surface in the press-contact state, the second image forming section is configured to form a toner image of a second color that is different from the first color, includes:

a third pressure receiving part provided to the first rotary body as one of the pair of pressure receiving parts and formed with a third pressure receiving surface contacted with the other one of the pair of pressure receiving part in the press-contact state; and a fourth pressure receiving part provided to the second rotary body as the other one of the pair of pressure receiving parts and formed with a fourth pressure receiving surface contacted with the third pressure receiving surface in the press-contact state, and the image forming apparatus is configured to satisfy both relationships expressed by:

L1<L3, and

L2>L4 in which L1 denotes a protruding distance of the first pressure receiving part extending from a central axis of the first rotary body to the first pressure receiving surface, L2 denotes a protruding distance of the second pressure receiving part extending from a central axis of the second rotary body to the second pressure receiving surface, L3 denotes a protruding distance of the third pressure receiving part extending from the central axis of the first rotary body to the third pressure receiving surface, and L4 denotes a protruding distance of the fourth pressure receiving part extending from the central axis of the second rotary body to the fourth pressure receiving surface.

2. The image forming apparatus according to claim 1, wherein each of the first and second image forming sections further includes a pair of pressure receiving parts contacted each other in the press-contact state in a second outer region located opposite to the first outer region interposed with the toner image forming region in the first and second rotary bodies, the first image forming section includes as the pair of pressure receiving parts in the second outer region, a fifth pressure receiving part provided to the first rotary body as one of the pair of pressure receiving parts in the second outer region and formed with a fifth pressure receiving surface contacted with the other one of the pair of pressure receiving parts in the second outer region in the press-contact state; and a sixth pressure receiving part provided to the second rotary body as the other one of the pressure receiving parts in the second outer region and formed with a sixth pressure receiving surface contacted with the fifth pressure receiving surface in the press-contact state, the second image forming section includes as the pair of pressure receiving parts in the second outer region, a seventh pressure receiving part provided to the first rotary body as one of the pair of pressure receiving parts in the second outer region and formed with a seventh pressure receiving surface contacted with the other one of the pressure receiving parts in the second outer region in the press-contact state; and an eighth pressure receiving part provided to the second rotary body as the other one of the pair of pressure receiving parts in the second outer region and formed with an eighth pressure receiving surface contacted with the seventh pressure receiving surface in the press-contact state, and the image forming apparatus is configured to satisfy relationships expressed by:

$$L1 \neq L5;$$

$$L2 \neq L6;$$

$$L1+L2=L5+L6;$$

$$L3+L4=L7+L8; \text{ and}$$

$$L1+L4 \neq L5+L8$$

in which L5 denotes a protruding distance of the fifth pressure receiving part extending from the central axis of the first rotary body to the fifth pressure receiving surface, L6 denotes a protruding distance of the sixth pressure receiving part extending from the central axis of the second rotary body to the sixth pressure receiving surface, L7 denotes a protruding distance of the seventh pressure receiving part extending from the central axis of the first rotary body to the seventh pressure receiving surface, and L8 denotes a protruding distance of the eighth pressure receiving part extending from the central axis of the second rotary body to the eighth pressure receiving surface.

3. The image forming apparatus according to claim 1, wherein the first image forming section includes a first protection region in the first outer region of the first rotary body, the first protection region being located other than in a region provided with the pair of pressure receiving parts, the first protection region includes a first protection part protruding toward the second rotary body from the central axis of the first rotary body, the second image forming section includes a second protection region which is overlapped with the first protection region of the second rotary body, the second protection region including a second protection part protruding toward the first rotary body from the central axis of the second rotary body, and the image forming apparatus is configured to satisfy a relationship expressed by:

$$L9+L10>LA+LB$$

in which L9 denotes a distance of the first protection part extending from the central axis of the first rotary body to a leading end of the first protection part, L10 denotes a distance of the second protection part extending from the central axis of the second rotary body to a leading end of the second protection part, LA denotes a radius of the first rotary body of the first image forming section in the toner image forming section, and LB denotes a radius of the second rotary body of the second image forming section in the toner image forming section.

4. The image forming apparatus according to claim 1, wherein the image forming apparatus further includes:

a display part for displaying information to a user;

a density value output part provided downstream of the first and second image forming sections in a toner-image conveying direction to detect and output a density value indicating a toner application amount on the toner image;

a test control part to perform a test control of forming a test pattern of a toner image for a predetermined test on at least one of the first and second image forming sections; and an allowable range recording section to record a predetermined allowable range of the density value of the test pattern, and the test control part performs the test control such that the test pattern is formed by at least one of the first and second image forming sections, and when the density value of the formed test pattern output from the density value output part is outside the allowable range, the display part displays that one of the developing roller and the image carrier is wrongly mounted in one of the first and second image forming sections which formed the test pattern.

5. The image forming apparatus according to claim 1, wherein one of the first and second image forming sections is configured to form a black toner image, and the other one is configured to form a toner image with a color other than black.

6. The image forming apparatus according to claim 1, wherein the first and second image forming sections each include an adjustment part to adjust the protruding distance of at least one of the pressure receiving parts.

7. A drum unit comprises an image carrier configured to rotate and to be applied with toner from a developing roller during image forming, the drum unit being mounted in an image forming section of the image forming apparatus according to claim 1 provided with a press part to press at least one of an image carrier and a developing roller to the other one to bring them in a press-contact state, wherein the drum unit further includes a pressure receiving part provided in the image carrier in an axially outer region located outside a toner image forming region which is to be applied with toner from the developing roller and formed with a pressure receiving surface contacted with a part of the developing roller which is overlapped with the outer region in the press-contact state, and the pressure receiving part has a protruding distance from a central axis of the image carrier to the pressure receiving surface, the distance being different from a distance of the similar type of drum unit including an image carrier to be applied with toner of a different color from a developing roller.

8. A developing unit comprises a developing roller to rotate and apply toner to an image carrier during image forming and an accommodation part to accommodate the toner to be supplied to the developing roller, the developing unit being mounted in an image forming section of the image forming apparatus according to claim 1 which is provided with a press part to press at least one of the image carrier and the developing roller onto the other one in image forming to bring them in a press-contact state, wherein the developing unit further includes a pressure receiving part which is provided in the developing roller in an axially outer region located outside a toner image forming region to apply a toner onto the image carrier, and the pressure receiving part has a protruding distance from a central axis of the developing roller to the pressure receiving surface, the distance being different from a distance of the similar type of developing unit including a developing roller to apply a toner with a different color to an image carrier.

* * * * *